US006300725B1

(12) United States Patent
Zinkler et al.

(10) Patent No.: US 6,300,725 B1
(45) Date of Patent: Oct. 9, 2001

(54) POWER SUPPLY FOR HYBRID ILLUMINATION SYSTEM

(75) Inventors: Victor Zinkler, Jerusalem; Shafrir Rimano, Rishon Lezion; Shaul Barak, Ramat Gan; Zvi Schreiber, Jerusalem, all of (IL)

(73) Assignee: Lightech Electronics Industries Ltd., Lod (IL)

( * ) Notice: Subject to any disclaimer, the term of this patent is extended or adjusted under 35 U.S.C. 154(b) by 0 days.

(21) Appl. No.: 09/161,995

(22) Filed: Sep. 29, 1998

Related U.S. Application Data

(63) Continuation-in-part of application No. 09/097,583, filed on Jun. 16, 1998, now abandoned.

(30) Foreign Application Priority Data

Jun. 16, 1997 (IL) ..... 121089
Oct. 9, 1997 (IL) ..... 121927

(51) Int. Cl.[7] ..... H05B 37/00

(52) U.S. Cl. ..... 315/291; 315/224; 315/312; 315/324

(58) Field of Search ..... 315/224, 209 R, 315/307, 308, 225, 206, 320, 324, 312, 313, 314, 247, 219, 318, 291

(56) References Cited

U.S. PATENT DOCUMENTS 4,508,996 * 4/1985 Clegg et al. ..... 315/224
4,667,133 * 5/1987 Nilssen ..... 315/312
4,939,381 * 7/1990 Shibata et al. ..... 315/224
4,949,020 8/1990 Warren et al. ..... 315/297
5,436,527 7/1995 Koening et al. ..... 315/97
5,583,402 * 12/1996 Moisin et al. ..... 315/307
5,621,281 * 4/1997 Kawabata ..... 315/311
5,640,069 * 6/1997 Nilssen ..... 315/209 R
5,773,937 * 6/1998 Miyazaki et al. ..... 315/209 R
5,798,617 * 8/1998 Moisin ..... 315/224

FOREIGN PATENT DOCUMENTS 3014419 10/1981 (DE) .
4218959 1/1993 (DE) .
0489477 6/1992 (EP) .

OTHER PUBLICATIONS

Patent Abstract of Japan, JP 07272871, Inventor—Yoshitake Toshimasa, "Lighting device for discharge type light source body".

Patent Abstract of Japan, JP 03266396, Inventor—Satomi Akira, "Electric discharge lamp lighting device".

* cited by examiner

*Primary Examiner*—Don Wong
*Assistant Examiner*—Wilson Lee
(74) *Attorney, Agent, or Firm*—Browdy and Neimark

(57) ABSTRACT

A track lighting hybrid illumination system comprising a power supply circuit having an input for connecting to a voltage source of low frequency for providing an output voltage with altered electrical characteristics, and a pair of conductors coupled to an output of the power supply circuit. A first lamp is coupled to the conductors via a second power supply circuit, and at least one further lamp with electrical power requirements of a different characteristic to the first lamp coupled to the conductors.

134 Claims, 20 Drawing Sheets

POWER SUPPLY FOR HYBRID ILLUMINATION SYSTEM

RELATED APPLICATION

This application is a continuation-in-part application of U.S. Ser. No. 09/097,583 filed on Jun. 16, 1998 and abandoned.

FIELD OF THE INVENTION

This invention relates to power supplies for illumination systems.

BACKGROUND OF THE INVENTION

In recent years, new forms of lighting including low-voltage halogen lamps and gas discharge lamps such as compact fluorescent and high intensity discharge lamps (or HID lamps including metal-halide and sodium lamps) have become increasingly popular owing to their superior efficiency and light color. Unlike conventional incandescent lamps which can be powered directly from the 120V/60 Hz or 230V/50 Hz utility power, these lamps require power supplies. Specifically, low-voltage halogen lamps require a transformer to provide a voltage typically equal to 12V and gas-discharge lamps require an ignition mechanism and a ballast to control the currents running through them.

With the increased popularity of these types of lamps, it is becoming increasingly important to find economical and aesthetic ways of providing for their power needs. It is also desirable to provide more versatile power supply systems which allow consumers to mix different types of lamps together economically and aesthetically, in a manner not hitherto allowed for.

In this context it is important to note that all known approaches to powering modem lamps involve having a single power supply for each lamp (with the limited exception that identical low-voltage halogen lamps can be connected in parallel to a single transformer in an arrangement known as a low-voltage lighting track) such arrangement necessarily being costly and anaesthetic in that individual power supplies are bulky and expensive.

It is known in the art that the transformer for a low-voltage lamp may be replaced by a small ferrite based transformer if the input voltage passes through an electronic inverter which produces a square-wave voltage of high frequency, typically about 30 KHz It is also known that a ballast for a gas discharge lamp, in which the central component is typically an inductance, can be made smaller by using electronic circuits switching at a high frequency again typically of the order of 30 KHz.

In particular, the approach of inverting 50 Hz or 60 Hz utility power to give high frequency current of 30 KHz modulated at 50 Hz or 60 Hz has been thought inapplicable to HID lamps because the arc in the HID lamps is likely to extinguish at the zero-crossing of the envelope due to the fact that the amplitude of the high frequency alternating voltage becomes very low for a number of milliseconds. Thus, there us up to now been no practical way to unify any elements of the power supplies for halogen and HID even had the concept of a central unit with some common elements been conceives In addition to the apparent lack of compatibility of the approaches to miniaturizing power supplies for halogen and HID, the use of high frequency for even systems of one type of lamp is subject to a drawback: namely that the square wave 30 KHz used in power supplies for lighting necessarily contains strong harmonics of much higher frequencies than 30 KHz. When the power supply is not adjacent to the lamp, the wires connecting the two act as a transmission line emitting electromagnetic radiation which can interfere with surrounding equipment and which may violate European, FCC or equivalent standards for electromagnetic compatibility. Clearly this drawback becomes far more serious as the power is increased and as the illumination system extends over larger distances. In practice, this places a limitation on the number of lamps which may be connected simultaneously to the system A low-voltage lighting track operating at 12V is known which is specifically designed for low-voltage halogen lights and which is sometimes powered by a so-called electronic transformer which includes a central inverter in combination with a central transformer. Such a system suffers from the problem described above and this is generally overcome by limiting the length of the system, particularly in Europe, to about two meters, and by limiting the current to about 20 amps or 25 amps, so as to limit the magnitude of the electromagnetic radiation emanating from the system. Clearly, this system cannot be used with lamps other than low voltage lamps.

SUMMARY OF THE INVENTION

It is therefore an object of the invention to power economically and aesthetically lighting systems containing mixed types of lamps (line-voltage incandescent, low-voltage incandescent, fluorescent, compact fluorescent and high intensity discharge) and/or mixed types of fixtures (track, recessed etc.) by having one central power supply circuit performing a number of functions which are relevant to all lamps while having secondary power supply systems which are relatively very small and very cheap adjacent to individual lamps.

One key function which may be achieved centrally according to the invention is the inversion of the utility power to a current of a much higher frequency.

One key aspect of the invention is an innovative approach to a ballast for HD lamps which is able to work with a central source of high frequency current even though the current may be modulated by a rectified 50 Hz or 60 Hz envelope. This is achieved by using higher voltages than is customary or by using an energy storage device (valley fill) to store energy for releasing to the lamp in order to preserve the arc at times around the zero crossing of the modulating envelope.

Another key aspect of the invention is an innovative approach to producing high frequency current which is not a square wave but rather has weaker harmonics than a square wave or, in one embodiment in which an inductance and a capacitance in the central power supply together with the external load form a resonant circuit, is virtually sinusoidal therefore reducing any problems of radio interference. Further, one of the ideas according to the invention is to keep the RMS voltage emanating from the central power supply substantially higher than 12V which is the value customary in the only high frequency system in use today (the so called low-voltage lighting track which when powered with a so called electronic transformer) therefore allowing far smaller currents to be used thereby further reducing the radio emissions and also reducing ohmic losses. In particular, these innovations allows the conductors carrying the power to the fixtures to be tens of meters in length compared to the two meters accepted in low-voltage lighting tracks, particularly in Europe, and allow the system to carry hundreds or a few thousand watts of power compared to about 250 W which is a common value in existing systems.

It is a further object of the invention to give better performance and further economies by optionally centralizing functions including the power factor correction, valley fill, supply of low-voltage power (typically 3V) for electrode heating of compact fluorescent lamps, protection circuits, high frequency filters and voltage stabilization.

According to a broad aspect of the invention there is provided an illumination system comprising:

a power supply circuit having an input for connecting to a voltage source of low frequency for providing an output voltage with altered electrical characteristics, a pair of conductors coupled to an output of the power supply circuit, and a first lamp coupled to the conductors via a second power supply circuit, and at least one further lamp with electrical power requirements of a different characteristic to the first lamp coupled to said conductors.

DETAILED DESCRIPTION OF PREFERRED EMBODIMENTS

Figure 1:
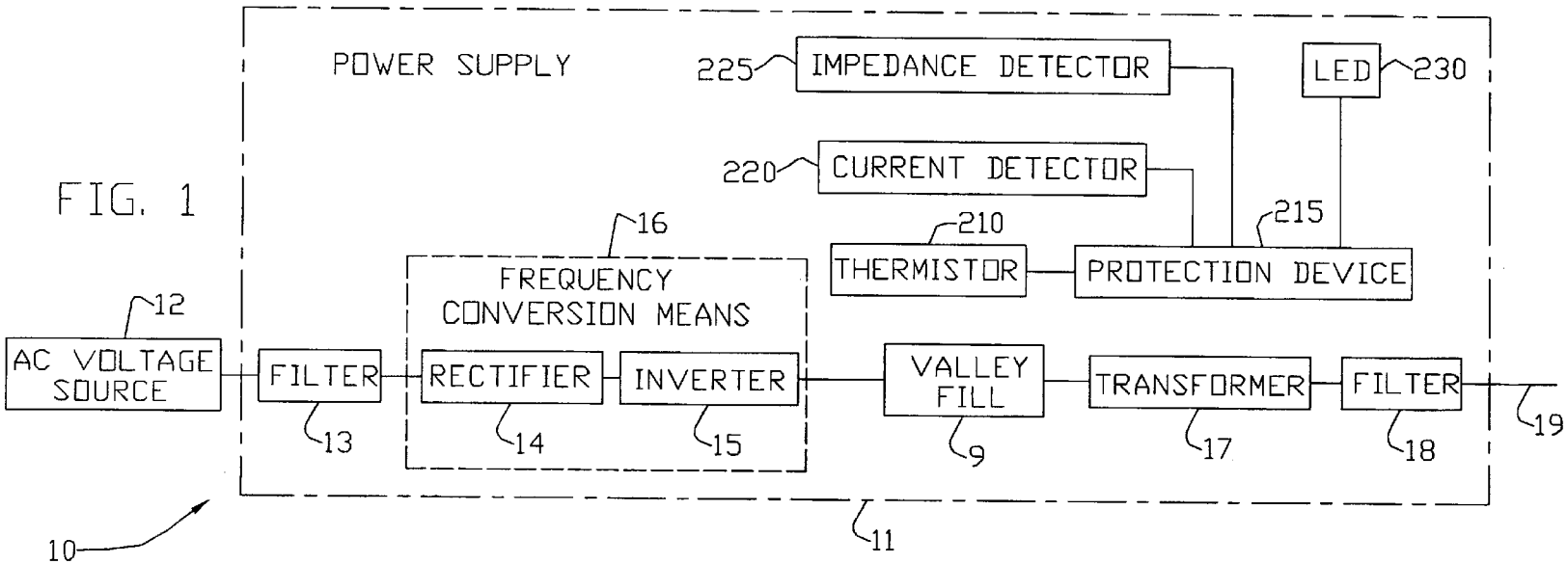
FIG. 1 is a block diagram showing the principal functional components of an illumination system according to the invention.

FIG. 1 shows an illumination system designated generally as 10 including a power supply 11 connected to an AC voltage source 12 typically 120V160 Hz or 230V/50 Hz as provided by an electricity supply utility. A low pass filter 13 is connected to an output of the AC voltage source 12 and prevents high frequencies generated within the system from being passed back into the AC voltage source 12. Connected to an output of the low pass filter 13 is a full-bridge rectifier 14 for converting the AC voltage to DC which is, in turn, fed to an inverter 15 comprising a chopper circuit which produces a square wave with a 50% duty cycle at a frequency of order between 15 KHz and 50 KHz. Frequencies in this range are above audible frequencies and low enough that the fundamental frequency is not subject to regulation The inverter 15 should preferably generate its oscillations independently of the current so as not to be influenced by changes in the current due to the operation of the HID lamps. The rectifier 14 in conjunction with the inverter 15 thus constitute a frequency conversion means 16 for converting the low frequency voltage produced by the AC voltage source 12 to a high frequency voltage. The chopper circuit can be implemented using known designs, Preferably using Field Effect Transistors.

Optionally a valley fill component 9 may be coupled to an output of the inverter 15 and serves to supply energy during the time just before and after the zero crossing of the AC Voltage Source in order to preserve the arc in HID lamps in the system. Instead, the valley fill can draw energy from a small power factor correction device, of the type described below in a different context in order to preserve a high power factor for the system. This valley fill can alternatively be included in the individual power supply adjacent to the HID lamp and is described below in detail in this context. It is understood that it can be implemented using a similar design within the central power supply 10 as block 9 as shown provided only that the components must then be rated for more power. In practice, it is desirable to implement the valley fill centrally only when it is known that a large proportion of the lamps being powered by the system will be HID lamps or other lamps which cannot stand dips in voltage as this function is only required for such lamps.

Optionally a high frequency transformer 17 is coupled to an output of the valley fill 9 and a low-pass filter 18 is connected to the output of the high frequency transformer 17 for reducing the amplitude of higher frequencies. The low-pass filter 18 can be implemented using an inductor of order 350 $\mu$H in series with the output of the high frequency transformer 17 and a capacitor of order 100 pF in parallel with the high frequency transformer's secondary winding. The inductance achieves a reduction of order 32 dB of frequencies above 3 MHz and a smaller reduction of lower frequencies. The capacitor reduces frequencies above 30 MHz by some extra 12 dB.

A pair of conductors 19 are connected to an output of the low-pass filter 18 and are associated with mechanical means for allowing connection of low-voltage halogen lamps with high-frequency transformers and/or gas-discharge lamps with high-frequency ballasts and ignition mechanisms and/or line-voltage incandescent lamps with a high-frequency transformer or directly. The mechanical means themselves are not a feature of the invention and are therefore not described in detail. However, it is noted that the invention is particularly suitable for use with track lighting in which the benefit of small power supplies adjacent to the lamps is clearly visible. The invention is also suitable for use with recessed lights and has the particular advantage that the high frequency transformer used adjacent to low-voltage halogen lights in the system requires no electronic components and therefore is less susceptible to damage from the heat of the lamp. The system is also suitable for outdoor, under-cabinet, wall mounted and other lighting forms. It further is particularly suitable for simultaneously powering different types of fixtures by suitable increasing the power rating of the central power supply and therefore achieving larger economies of scale.

The high frequency transformer 17 is preferably ferrite based, with the secondary implemented by a litz and serves for transforming the AC voltage produced thereby so that as to ensure that the RMS magnitude of the voltage on the conductors 19 is of a convenient magnitude. There are several possible choices for this magnitude. One possibility is to choose this magnitude below approximately 30V: this having the advantage that danger of electrocution is eliminated and the conductors can be exposed as in open conductive rail and cable systems. More specifically, if the conductor voltage is set to 12V, this has the further advantage that low-voltage halogen lamps may be powered directly from the conductors; and similarly if it set to 24V this has the advantage that xenon lamps may be powered directly from the conductors. However, low voltages have the disadvantage that they necessitate higher currents creating increased ohmic and radiative losses on the conductors and increased radio interference.

According to a second option, the magnitude of the conductor voltage can be chosen equal to the magnitude of the AC source 12 so that ordinary incandescent lamps, designed for use with the AC source (typically 120V or 230V RMS) can be attached without further conditioning to the output of the power supply 11 (as incandescent lamps require a specified RMS voltage but are largely insensitive to frequency).

According to a third option the magnitude of the conductor voltage may be chosen equal to some international standard so that despite differences in the AC source provided by the utility, lighting fixtures for use with the system can be universal. This magnitude is preferably set equal to the magnitude of the utility power in a required market destination so that line-voltage incandescent lamps from that market may be used directly with the system. The relevant standards are therefore 100V, 110 to 120V and 220 to 240V.

According to a fourth option, the magnitude is chosen to be higher than even 240V in order to minimize the time around the zero crossing of the envelope due to variation of the AC source in which the voltage across the conductors 19 falls below approximately 200V in order to provide for easier preservation of the arc in any HID lamps in the system, preferably without the need for the valley fill system described in detail below.

The length of the conductors 19 can be several meters up to tens of meters depending on the power and on prevailing regulatory standards. The power rating can be not only in excess of 300 W which is typically the limit today but in fact it can be in excess of 1,000 W.

In the presence of filter 18, the voltage across the conductors 19 is filtered at a frequency of 30 KHz, thereby reducing electromagnetic interference, and optionally at a voltage substantially higher than 12V so that associated currents are lower, thereby further reducing electromagnetic interference. This is in contrast to known track systems which either carry current with a voltage and frequency equal to the line voltage provided by the electricity supply utility, or carry a low voltage of 12V often with a square wave of frequency 30 KHz.

Figure 19:
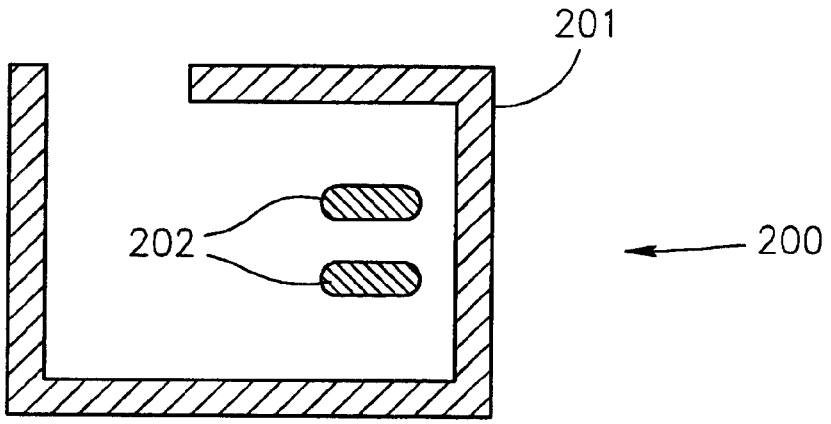
FIG. 19 shows a cross-section of a metallic lighting track particularly suitable for use with the invention.

The conductors 19 can be contained in a rigid or flexible insulating track to which the lighting fixtures are attached, or can be carried in wires to recessed, under-cabinet, wall-mounted or outdoor lighting fixtures. Preferably any track used is metallic in order to provide electromagnetic shielding and is such that there is no straight path or only a very small open angle from the conductors to the outside of the track Preferably the pair of conductors is physically close to each other, as close as allowed by safety standards, in order to reduce electromagnetic radiation which is proportional in magnitude to the area between the conductors. In one preferred arrangement the conductors are flat, i.e. of rectangular cross-section, and ran with their surfaces parallel to each other. A cross-section of a track with all these features is shown in FIG. 19.

Optionally, there may be routed alongside the conductors 19 extra conductors which are connected directly to the electricity supply utility and to which respective groups of conventional fixtures can be attached. For example, in Europe it is conventional to have one neutral conductor and three 230V150 Hz conductors connected to the electricity supply utility and which can be switched on or off independently so as to allow the different groups of fixtures to be illuminated or extinguished independent of the other groups of fixtures. This set of four wires can run alongside the conductors 19 or the neutral conductor can be common to the conventional and high frequency systems.

Optionally, the single pair of conductors 19 can be replaced by a larger number of pairs of conductors, typically three, with or without a common neutral conductor, so as to allow the high-frequency fixtures also to be switched on or off in independent groups. In such an arrangement, the switching may be accomplished either by having a separate power supply for each conductor each similar to the power supply 11, or by connecting the output of one common power supply to all three through relays which can be controlled by the user.

According to the invention there may be provided in parallel to the conductors 19 a further pair of conductors (with or without a common neutral) providing a low-voltage for the heating of the electrodes in fluorescent or compact fluorescent lamps in the system. This can be powered using a standard low power 3 volt power supply, to be housed together with the power supply 11, and implemented using known designs. The power supplied by the valley fill may alternatively be supplied using a separate conductor running in parallel to the conductors 19.

The system 11 is encased within a housing (not shown) on which is mounted a pair of terminals connected to an output of the power supply circuit 11 for attaching at least one lighting fixture thereto via the conductors 19. Within the housing there may optionally be provided a thermistor 210 (constituting a temperature sensing means) for measuring an ambient temperature and to which is responsively coupled a protection device 215 for interrupting the output voltage in the event of overheating. Similarly, a current sensing means 220 may optionally be coupled to such a protection device for interrupting the output voltage in the event of the output being overloaded or short-circuited. Such overheating and overcurrent protection devices are known per se and are therefore not described in further detail. It is noted however that the implementation of these protections in a central way for lighting systems which may be mixed is not known in the art.

Alternatively, an overload protection can employ an impedance detector 225 based on the fact that the impedance across the conductors decreases below a minimum allowed threshold consequent to a short-circuit or overload. Such a drop in impedance may be detected by a comparator which has a first input connected to a voltage divider across the ground and live conductors in the system and which therefore differs from the ground voltage by an amount which is proportional to the voltage across the conductors. A second input of the comparator is connected to a small resistor in series with the ground conductor so as to generate a voltage which differs from the ground voltage by an amount which is proportional to the current flow through the resistor. This implementation has the advantage that it can detect an overload instantaneously even during that part of the 50/60 Hz AC cycle where the instantaneous voltage is near zero such that the instantaneous current has not yet exceeded the threshold.

In either the current or the impedance overload protection circuit, it is desirable to deactivate the protection for a short time following connection to the AC voltage source in order that cold incandescent lamps in the system have time to heat up and are not mistaken for a short-circuit on account of their low impedance when cold.

Optionally, a respective light emitting diode 230 can be connected to each protection device in order to provide a visible indication of its operation.

Figure 2:
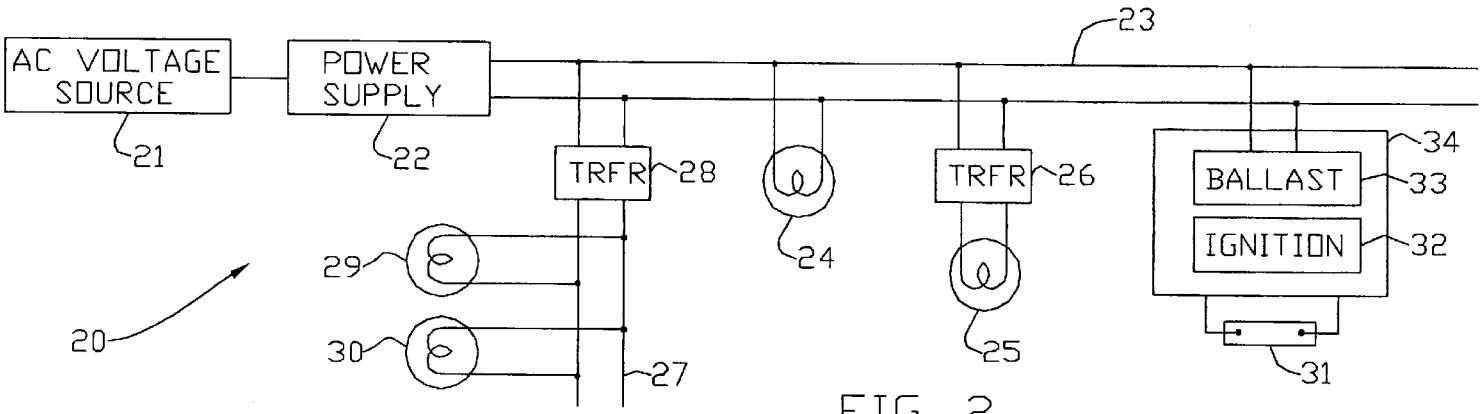
FIG. 2 shows the use of the illumination system depicted in FIG. 1 for simultaneously powering mixed lighting units.

FIG. 2 shows a complex illumination system depicted generally as 20 using the principles described above with reference to FIG. 1 of the drawings. An AC voltage source 21 derived from the electrical supply utility is connected to a power supply 22 corresponding to the power supply 11 of FIG. 1, which outputs a voltage optionally substantially higher than 12V at a frequency of order 30 KHz to a pair of conductors 23. The conductors 23 can typically carry hundreds or a few thousand watts of power and be tens of meters in length owing to the relatively high voltage and corresponding low current and the optional suppression of higher frequencies.

An incandescent lamp 24 designed to work with a voltage equal to the output voltage of the power supply 22 is connected directly across the conductors 23. A 12V halogen lamp 25 or other low voltage incandescent lamp is also connected across the conductors 23 via a first high frequency transformer 26 which is particularly small and inexpensive on account of the use of high frequency current in the conductors 23. A low voltage rail 27 is connected to the conductors 23 via a second high frequency transformer 28 with output of 12V and with a greater power rating than the transformer 26. The low voltage rail 27 comprises a pair of heavy gauge auxiliary conductors having sufficient current rating to allow connection thereto of several low voltage lamps 29 and 30. The low voltage rail 27 can be constituted by a conventional low-voltage track A gas discharge lamp such as compact fluorescent 31 is connected to the conductors 23 or to a separate dedicated track via a high frequency ignition circuit 32 and a high-frequency ballast 33 such as described in U.S. Pat. No. 3,710,177 which is incorporated herein by reference. Preferably in the case of compact fluorescent there is also provided a 3V power supply for heating of the electrodes either associated with the power supply 34 or implemented centrally as described above.

The power supply 22 can equally be constituted by the alternative arrangements described below in FIG. 4 or FIG. 6 of the drawings.

Figure 3A:
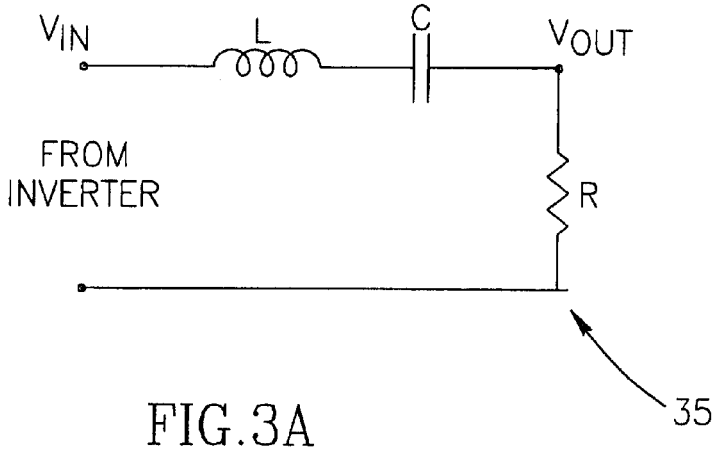
FIGS. 3*a* and 3*b* show respectively an LC resonant circuit for connecting to the inverter and graphical representations of various Q-factors associated therewith useful for explaining the effect of using a resonant tank.

Referring to FIG. 3*a*, there is shown schematically an LCR damped resonant circuit 35 which can replace the filter 18 shown in FIG. 1 for filtering out high frequencies and which is based on the introduction of a capacitance and inductance which together with the load created by the lamps form a damped resonant circuit Thus, the LCR damped resonant circuit 35 comprises an inductance L and a capacitance C which are mutually connected in series with an output of the frequency conversion means 16 whilst the lamps, designated collectively by their equivalent impedance R, are connected across an output of the filter 35. It will be appreciated that this concept is fundamentally different to hitherto proposed illumination systems in that the load of the lamps is not simply serviced by the power supply but is actually treated as part of the power supply system.

Figure 3B:
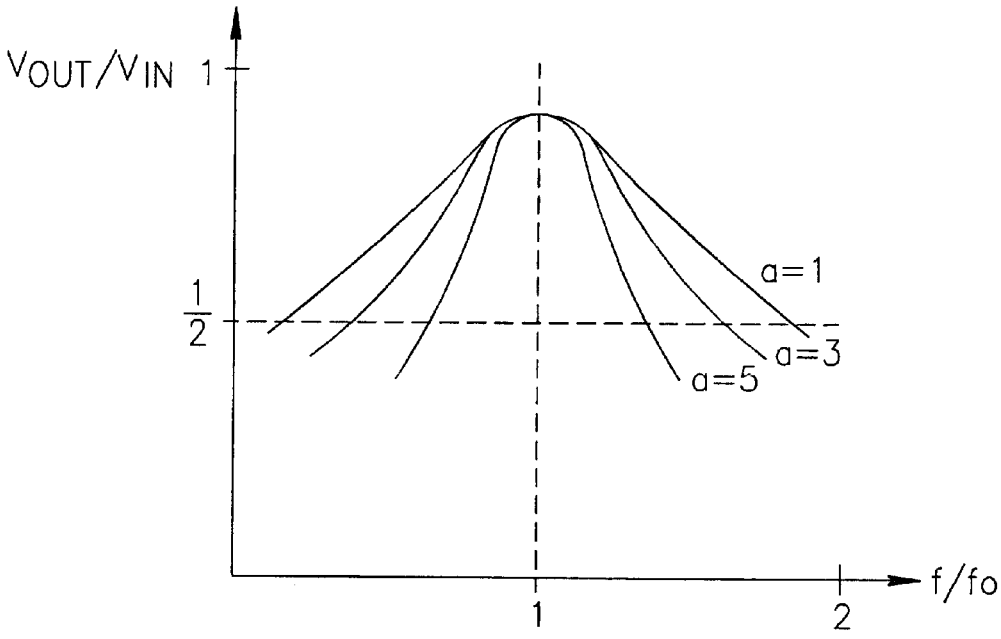

The magnitudes of the inductance L and capacitance C are chosen so that the resonant frequency of the filter 35 given by $f_0=1/(2\pi\sqrt{LC})$ is of the order of 15 KHz to 50 KHz and preferably approximately 20 KHz. In one arrangement to be described in detail, the inverter 15 shown in FIG. 1 is chosen to work at a frequency always higher than $f_0$ but changing in a way to be described below with reference to FIG. 3*b*.

In such an arrangement, the voltage $V_{in}$ output by the inverter will not in general be equal to the voltage $V_{out}$ across the lamps. The ratio $V_{out}/V_{in}$ is shown graphically in FIG. 3*b* as a function of the ratio between f and $f_0$. Thus, as shown, $V_{out}/V_{in}$ peaks at the resonant frequency $f_0$, whilst for deviation of frequency f away from the resonant frequency $f_0$, it falls off in a manner which depends on the quality factor Q given by $(1/R)\sqrt{L/C}$. The precise calculation of this graph is well known and therefore not described further.

Typically the RMS value of $V_{in}$ is constant but Q changes as lamps are added or removed thereby changing the value of the impedance R. The invention thus allows for the value f to be varied whenever the load R changes so that the ratio $V_{out}/V_{in}$ and hence the value $V_{out}$ remains constant.

The constant ratio $V_{out}/V_{in}$ is chosen to be of a convenient magnitude, typically of the order ½, so that at low loads (high Q) the required frequency f is not too close to $f_0$ but so that on the other hand at high loads (low Q) f is not more than about $2f_0$. In this manner, the frequency f is varied within a band typically of order $1.2f_0$ to $2f_0$ in accordance with the prevailing load so as to keep the value $V_{out}$ constant. Higher harmonics which are also generated by the inverter are effectively eliminated by the arrangement so the current on the conductors closely approximates to a sine wave.

Figure 4:
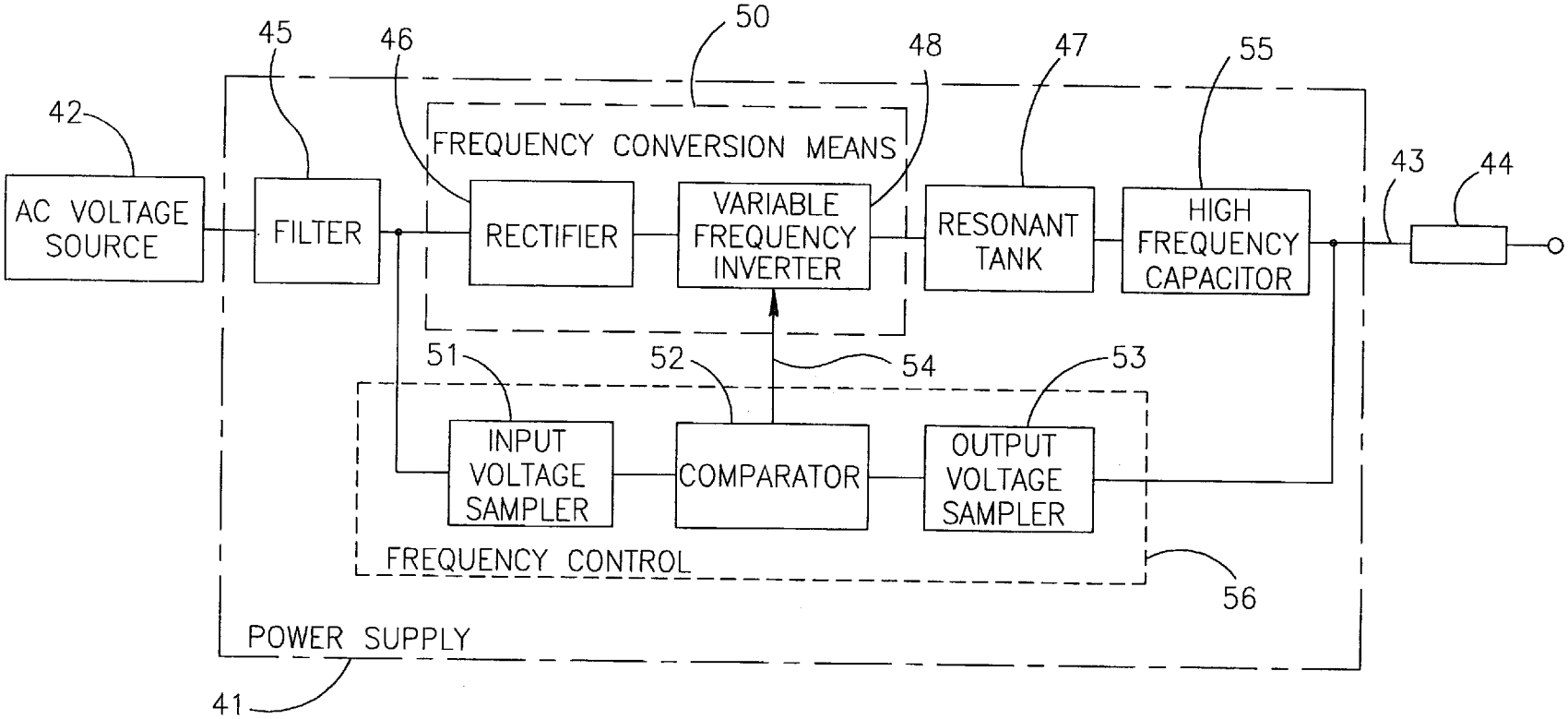
FIG. 4 is a block diagram showing the principal functional components of an illumination system according to the invention in which a sinusoidal output is achieved using a resonant tank based on the principles shown in FIGS. 3*a* and 3*b;*

FIG. 4 is a block diagram showing the principal functional components of an illumination system 40 according to the invention in which a sinusoidal output is achieved using a resonant tank based on the principles explained above with reference to FIGS. 3*a* and 3*b* of the drawings. Thus, the system 40 comprises a power supply designated generally as 41 which is connected across an AC voltage source 42. Connected to an output of the power supply 41 is a pair of conductors 43 across which lamps are connected to form a load 44. The power supply 41 comprises a filter 45, a rectifier 46 and a step up transformer (not shown) which are equivalent to the corresponding elements in the basic system shown in FIG. 1 and therefore require no further description. Connected to an output of the rectifier 46 is a variable frequency inverter 48 whose output is fed to a resonant tank 47 comprising an inductance L and a capacitance C both in series with an output of the variable frequency inverter 48. The rectifier 46 in combination with the variable frequency inverter 48 constitutes a frequency conversion means 50 for converting the low frequency voltage produced by the AC voltage source 42 to a high frequency voltage. The variable frequency inverter 48 is a half bridge or full bridge chopper circuit which produces a square wave with a 50% duty cycle and is based on transistors which are again preferably Field Effect Transistors and can be driven using available integrated circuits such as International Rectifier's IR2110. The square wave input which gives the timing for the drive is generated by a VCO component such as those available from Motorola, Linear and Texas Instruments.

The voltage at the output of the low pass filter 45 is sampled by an input voltage sampler 51 whose output is fed to a first input of a comparator 52. Likewise, the voltage across the conductors 43 is sampled by an output voltage sampler 53 whose output is fed to a second input of the comparator 52. An output 54 of the comparator 52 is fed to the variable frequency inverter 48 in order to implement the desired change in the frequency f thereof in order to stabilize a voltage across 43 upon changes in the load 44.

The optional step up transformer adjusts the voltage $V_{out}$ on the conductors 43 to the required value. The voltage $V_{out}$ is lower than the voltage $V_{in}$ of the AC source not only by the ratio $V_{out}/V_{in}$ but also owing to internal losses and on account of the elimination of all the power carried in non-fundamental frequencies. The step up transformer can be used to ensure that the voltage $V_{out}$ across the conductors 43 is equal to the voltage of the AC source 42 or to any other desired value. Connected across the secondary of the step up transformer is a high frequency capacitor 55 whose capacitance is of the order of 100 pF for eliminating frequencies of order above several MHz which are not effectively eliminated by the resonant tank 47 owing to the imperfect behavior at high frequencies of the capacitor C therein.

Preferably, the comparator 52 is implemented by an operational amplifier whose output signal 54 is proportional to, but much larger than, the difference between its two input signals. Alternatively, the comparator 52 can be implemented using discrete components. The input and output voltage samplers 51 and 53 in combination with the comparator 52 constitutes a frequency control means 56 for producing a control signal at the output 54 of the comparator 52 which controls the frequency f so as to keep the output voltage across the conductors 43 at the desired value. In particular, the system will in practice change f whenever there is a change in the load 44 and hence in the quality factor, so as to keep the voltage across the conductors 43 at the same desired RMS value.

The manner of choosing L and C will now be described. In the first instance, the product LC is chosen so that $f_0=1/(2\pi\sqrt{LC})$ is of the order 20 KHz which is a convenient lower bound for the working frequency f. In addition, L and C must be chosen so that Q does not get too low even when the load is minimal, so that it should never be necessary to work with f more than about 30 KHz. For example, if $V_{out}/V_{in}$ is chosen to be of the order of 0.5, then standard calculations show that Q must not be below approximately 1.

It may thus be shown that, if, for example, the load comprises low voltage halogen lamps with the minimum load being 50 W and if $V_{in}$ is 230V and $V_{out}$ is 115V, then, at its highest, R is effectively $115^2/50=265$ Ohms and if Q is not to exceed 1, then $\sqrt{(L/C)}$ must be of order 265 Ohms. Combining with the above constraints gives suitable values in this case of C=30 nF and L=2.1 mH.

A supplementary albeit inconvenient method of limiting the necessary variation in f is to have a bank of capacitors and/or inductors each having different values of C and L, respectively. Respective transistor switches are coupled to the capacitors and inductors and constitute a selection means for selecting a suitable inductance and/or a suitable capacitance such that the frequency of the resonant circuit is within a range of approximately 15 KHz to 50 KHz for a substantial range of different lamp-fixture loads.

Within the frequency control circuit 56, the output voltage sampler 53 comprises a resistor divider producing a voltage proportional to, but lower than, the voltage across the conductors 43. This voltage is fed into an integrated RMS to DC component which produced a DC voltage proportional to the RMS voltage across the conductors 43 which in turn is fed to the comparator 52.

The input voltage sampler 51 feeds a DC signal to the comparator 52 which is proportional to the desired voltage across the conductors 43 In the simplest case, the input voltage sampler 51 provides a fixed reference voltage using standard components for this purpose. This has the advantage of giving the system a method of voltage stabilization. However, this will have the effect that the voltage across the conductors 43 is fixed even in the event that the voltage from the AC source 42 is intentionally lowered by the use of a dimmer which has the effect of cutting out parts of the sine wave thus lowering the RMS voltage. The effect of such a dimmer on the AC voltage source is illustrated graphically in FIG. **8*i*** it being understood that other dimmers eliminate the leading part of the half-cycle rather than the trailing part as shown.

In a more sophisticated version, the input voltage sampler 51 is built similar to the output voltage sampler 53 so as to produce a DC voltage proportional to the RMS voltage of the AC voltage source 42. This has the effect that the RMS voltage across the conductors 43 is equal or proportional to the RMS voltage across the AC voltage source 42 and varies as required when a dimmer is in use. However, such a system also suffers from the disadvantage in that unwanted variations in the AC voltage source 42 owing to reliable utility power are passed on to the lamps.

Figure 5:
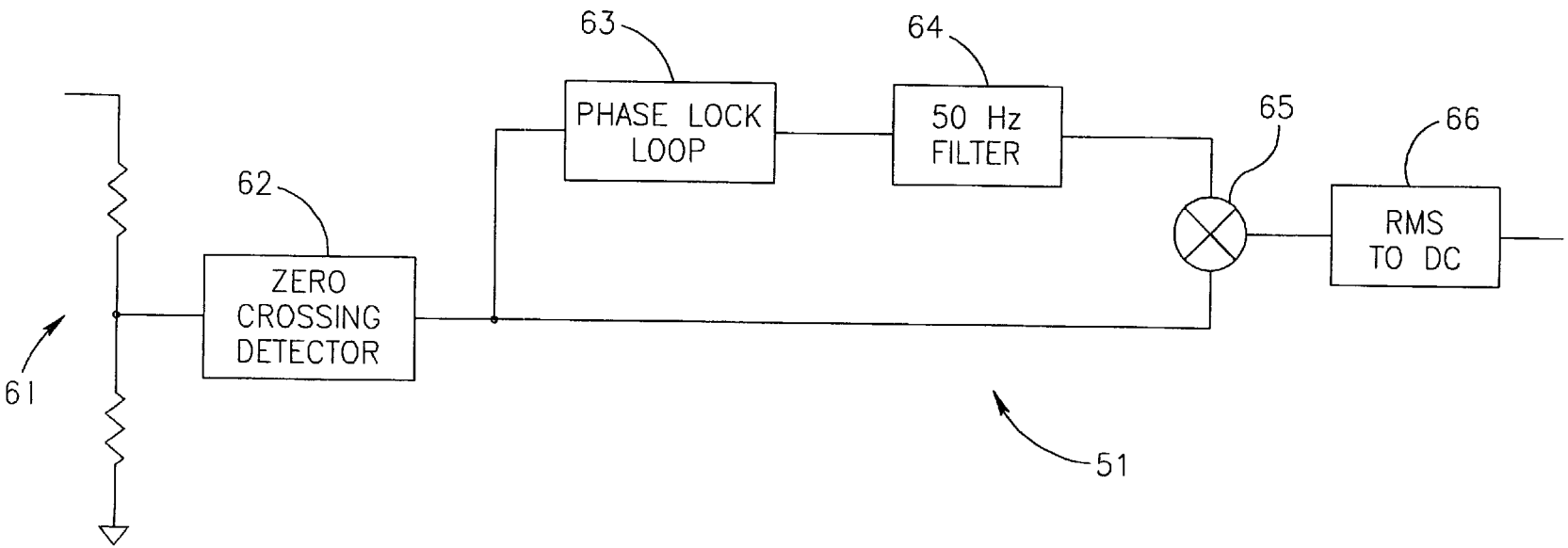
FIG. 5 is an electrical scheme showing a design for the input voltage sampler in FIG. 4.

FIG. 5 shows an electrical scheme for implementing the input voltage sampler 51 according to an even more sophisticated design which outputs a DC voltage proportional to the RMS voltage of a sine wave of fixed amplitude but which is cut at the same points as the AC voltage source 42 in order to retain the effect of the dimmer. A partition 61 of the sampled voltage is fed to a zero-crossing detector 62 which produces a logical output of −1,0,1 according to whether the sampled voltage is negative, zero or positive. This is then fed into a Phase Lock Loop system 63 (such as the component generally denoted 4046) which is set up so as to produce a square wave of fixed amplitude and which is phase locked to the phase of the sampled AC source 42. The output of the Phase Lock Loop is fed to a filter 64 so as to produce a sinusoidal wave of fixed amplitude in phase with the sampled power. The output of the filter 64 is multiplied by the output of the zero crossing detector 62 by means of a multiplier 65 in order to simulate the effect of a dimmer by chopping the sinusoidal reference wave. The resulting voltage is then passed through an RMS to DC converter 66 so as to provide the reference voltage to the comparator 52.

Figure 6:
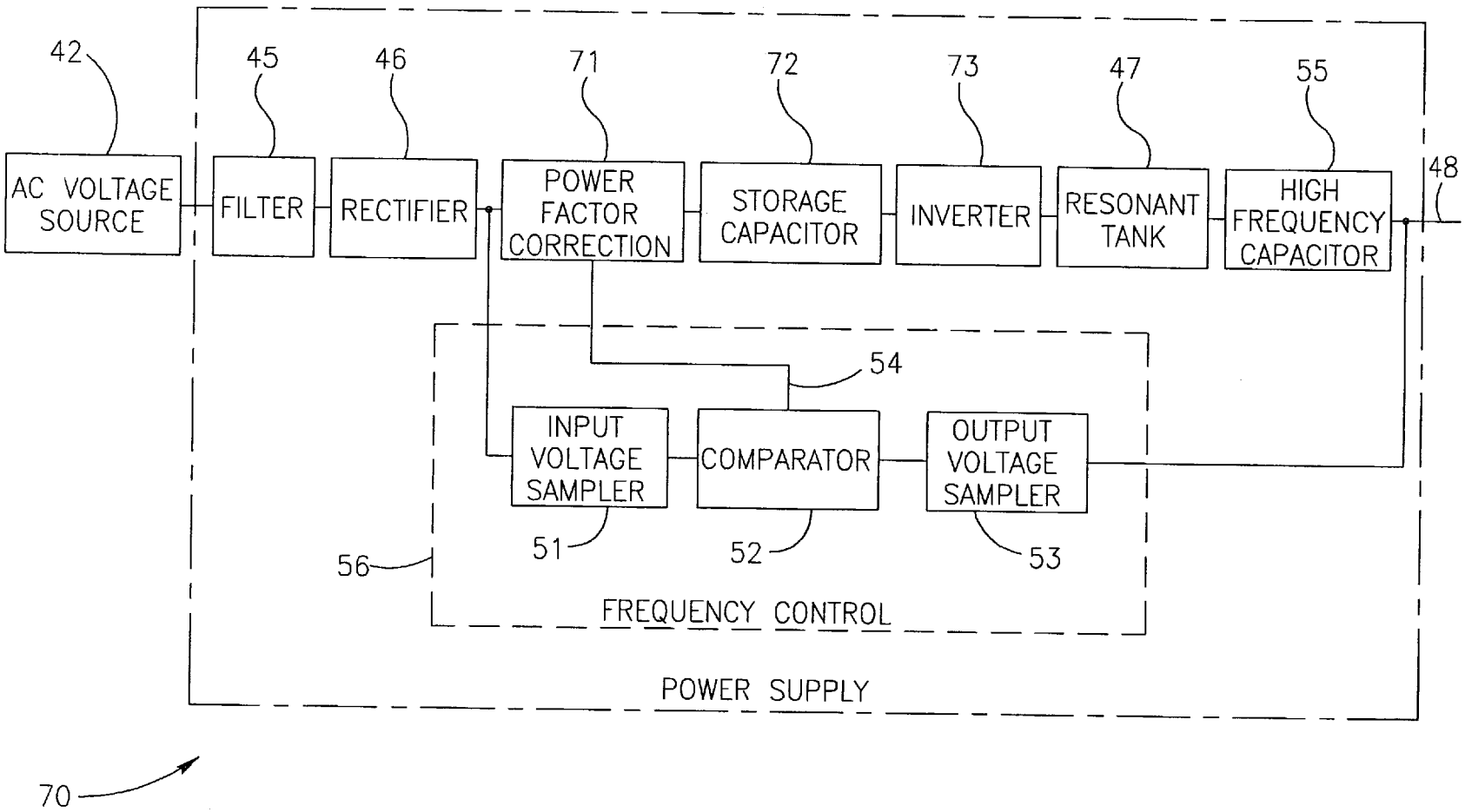
FIG. 6 is a block diagram showing the principal fictional components of an illumination system according to the invention in which a sinusoidal output is achieved using a resonant tank and in which there is a power factor correction circuit.

It will be appreciated that with the sinusoidal output of the embodiment described above with reference to FIG. 4, it becomes feasible to implement the system with an output voltage as little as 12V despite the larger currents involved FIG. 6 is a block diagram showing the principal functional components of an illumination system 70 similar to the system 40 shown in FIG. 4 but further including a power factor correction circuit 71. To the extent that similar components are used in both circuits, identical reference numerals will be employed Thus, the power factor correction circuit 71 is connected to an output of the rectifier 46 and a capacitor 72 is connected to an output thereof. The power factor correction circuit 71 and the capacitor is 72 ensure that the system draws current in phase with the voltage of the AC source 42 so as to ensure a power factor of near unity. It also maintains a near-constant DC voltage across the capacitor 72 which is fed to the inverter 73.

The rest of the system in FIG. 6 is equivalent to that in FIG. 4 except that there is no need to vary the frequency of the inverter 73 as it is possible instead to vary the voltage input to the inverter 73 using the power factor correction circuit 71, when there are changes in the load. This embodiment has the advantage of being power factor corrected which is particularly important when gas discharge lamps are in use.

It should be noted that the use of power factor correction also has advantages as an addition to the power supply of FIG. 1 and not only in conjunction with the resonant circuit. Its advantages in that case include increasing the power factor of the power supply to near unity and removing the need for a valley fill. In the resonant design, it has the further advantage of eliminating the need for varying the frequency.

It should also be noted that a totally different use of the power factor correction according to the invention is to eliminate the central inverter and connect the DC output of the power factor correction unit directly, or via a transformers, to a pair of conductors, for attaching thereto lighting fixtures which include their own inverter. This constitutes an alternative way of deriving some of the benefits of centralization while avoiding any radio interference problems.

Figure 7:
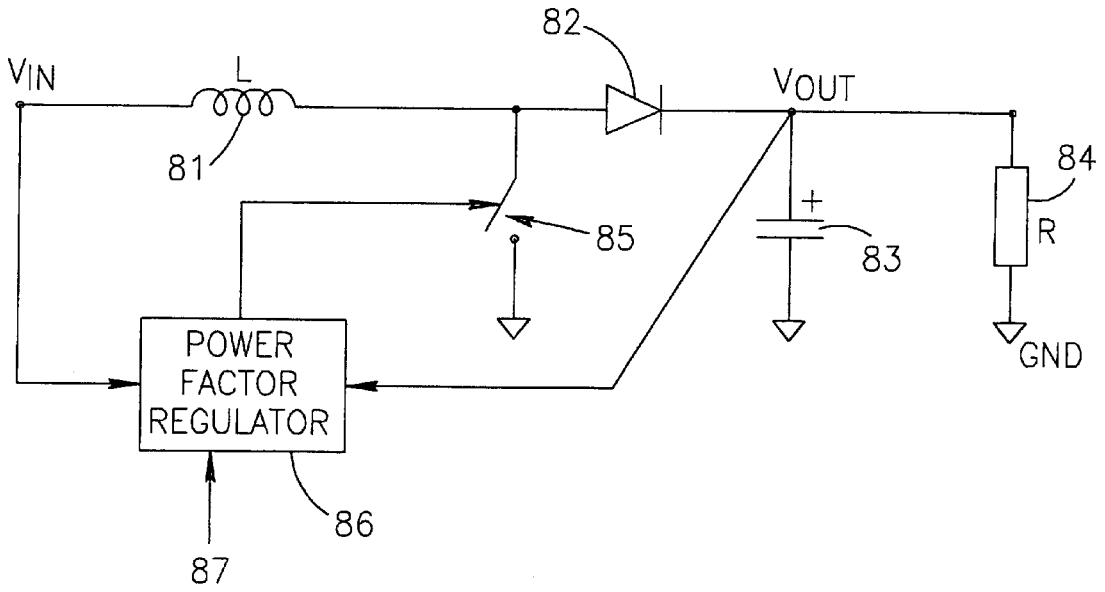
FIG. 7 is a circuit diagram showing a design for the power factor correction of FIG. 6.

FIG. 7 is a circuit diagram showing a design for the power factor correction circuit of FIG. 6. Thus, as shown, the input voltage $V_{in}$ is fed to an inductor 81 which is connected to the anode of a rectifier diode 82 whose cathode is connected to one terminal of a large capacitor 83 corresponding to 72 in FIG. 6 which has a capacitance of the order of hundreds of $\mu$F and whose other terminal is connected to ground, GND. The load 84 represents the rest of the system connected across the capacitor 83. One end of a gate 85 (constituting a switching means) is connected between the junction of the inductor 81 and the diode 82 whilst its other end is connected to GND. The gate 85 is controlled by a power factor regulating integrated circuit 86 such as 3852 and can be closed so as to charge the inductor 81 and opened so as to pass current through the diode 82 thereby charging the large capacitor 83. This closes the gate 85 at a frequency of the order of 30 KHz and with a duty cycle which varies sinusoidally in phase with the voltage $V_{in}$. It also varies the duty cycle in order to maintain the output voltage, $V_{out}$ at a constant pre-set value determined by a control signal 87 (corresponding to the output 54 of the comparator 52 in FIGS. 4 and 6) which is fed to the VFB pin of the 3852. The capacitor 83 ensures that $V_{out}$ is almost constant over the 30 KHz and 50 Hz cycles.

It is to be noted that the voltage $V_{out}$ must always be larger than the peak value of $V_{in}$. Care must be taken that when a dimmer is used, the peak value of $V_{in}$ may be unaffected although the system will reduce the pre-set value of $V_{out}$. Therefore $V_{out}$ must be sufficiently large to begin with such that it will be larger than the peak value of $V_{in}$ even after being reduced when a dimmer is introduced. The final voltage applied to the lamps can be reduced compared to $V_{out}$ by using a half-bridge inverter and/or by using a frequency differing from the resonant frequency. This embodiment saves the necessity of having a power factor correction circuit and or valley-fill for each gas discharge lamp in the system.

It will be appreciated that the power supply 53 has applications other than in illumination, as a power supply which is power factor corrected and which provides a pure sinusoidal output voltage of stabilized and adjustable magnitude. In order to make such a power supply more versatile, the frequency of the inverter can be made responsive to an external control signal. Further, the control signal 54 can be generated externally rather than being connected to the comparator 52.

Referring now to FIGS. 8*a* to 8*i* there are shown graphically voltage waveforms associated with the various embodiments described above with reference to FIGS. 1, 4 and 6 of the drawings.

Figure 8A:
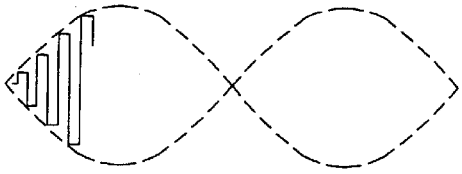
FIGS. 8*a* to 8*i* are graphical representations of various waveforms associated with different embodiments of the invention.
Figure 8B:
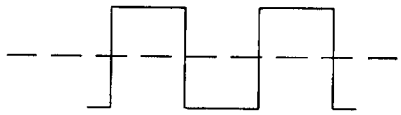

FIG. 8*a* shows graphically and FIG. 8*b* shows in a greatly enlarged scale (im which one and a half 30 KHz cycles are shown), the unfiltered output of a chopper circuit. It comprises a square wave of order 30 KHz modulated by a sinusoidal wave of 50 Hz/60 Hz.

Figure 8C:
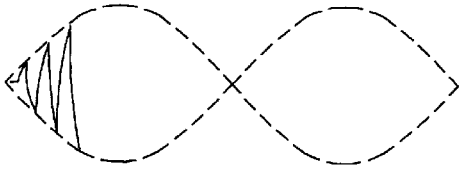
Figure 8D:
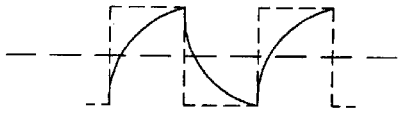

FIG. 8*c* shows graphically and FIG. 8*d* shows in a greatly enlarged scale the output of the embodiment described above with reference to FIG. 1. The waveform comprises a voltage of frequency of order 30 KHz, substantially smoother than a square wave, modulated by a sine wave of frequency 50 Hz/60 Hz.

Figure 8E:
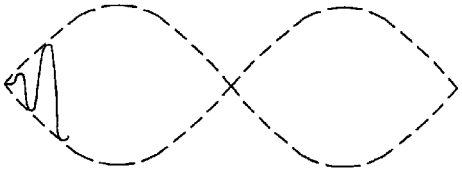
Figure 8F:
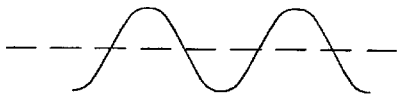

FIG. 8*e* shows graphically and FIG. 8*f* shows in a greatly enlarged scale the output of the embodiment described above with reference to FIG. 4. The waveform comprises a substantially sinusoidal voltage of frequency of order 20 KHz to 50 KHz depending on the load, modulated by a sine wave of frequency 50 Hzt60 Hz.

Figure 8G:
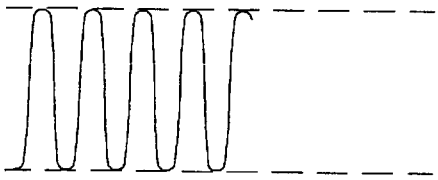
Figure 8H:
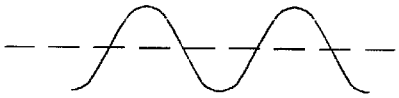
Figure 8I:
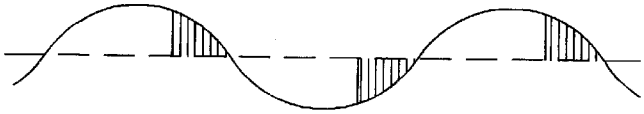

FIG. 8*g* shows graphically and FIG. 8*h* shows in a greatly enlarged scale the output of the embodiment described above with reference to FIG. 6. The waveform comprises a substantially sinusoidal unmodulated voltage of frequency of order 30 KHz. The lack of modulation has the extra advantage that the peak voltage is only $\sqrt{2}$ times greater than the RMS voltage as opposed to 2 times greater when this sine wave is modulated by a further sine wave as in FIGS. 8*a*, 8*c* and 8*e*.

Having described in some detail the central power supply of the invention, the implementation of the power supply unit 34 of FIG. 1 will now be described in detail for the case where the lamp 31 is an HID lamp. The function of power supply unit 34 is to accept the (possibly modulated) 20 kHz to 30 kHz current from the conductors 23 and provide a stabilized current to the lamp which is of substantially lower frequency and which preferably drops to a voltage of below 100V for a shorter time than the utility power in each 50 Hz or 60 Hz cycle thus avoiding the extinguishing of the arc.

Figure 9:
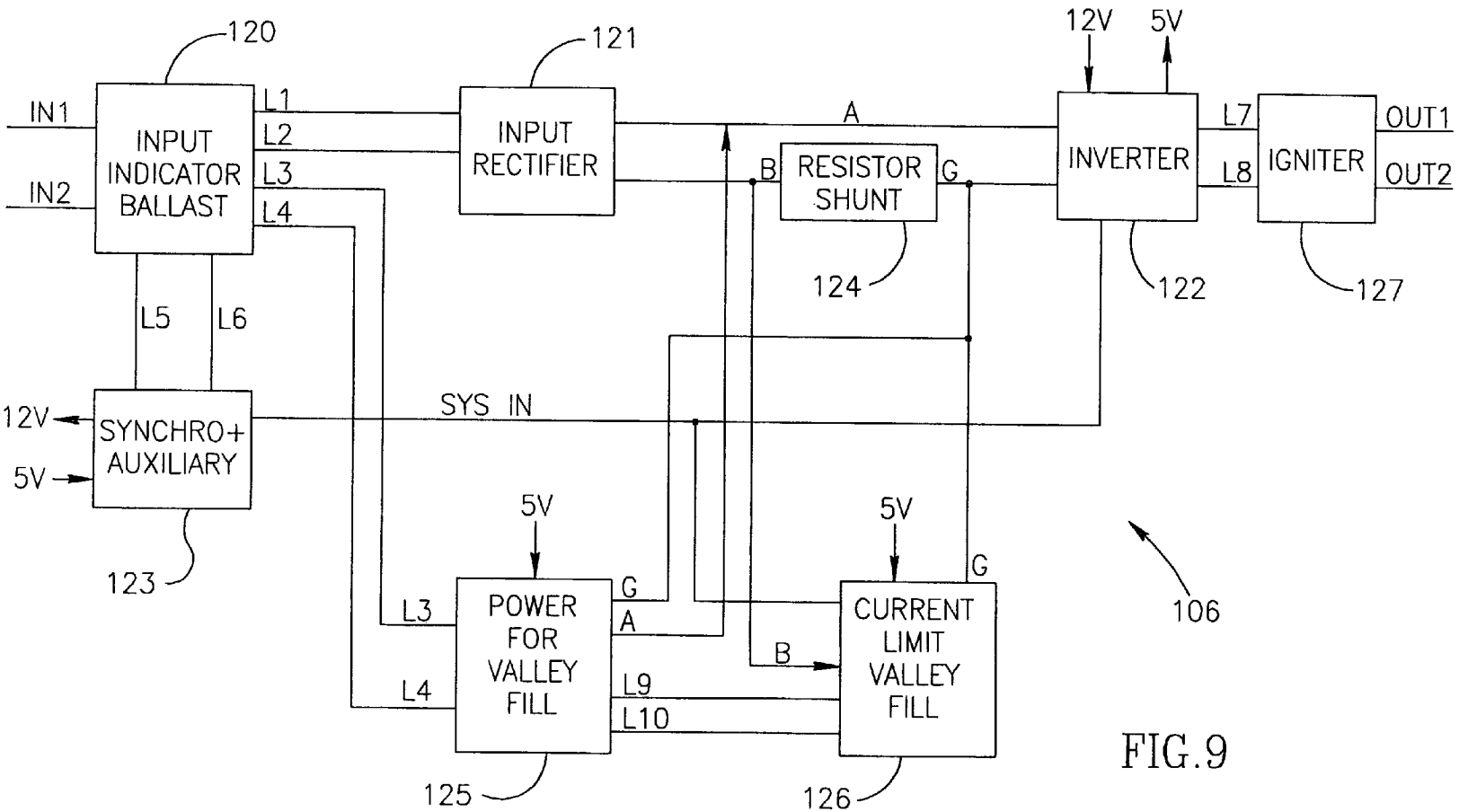
FIG. 9 is a block diagram showing the principal functional components of an HID ballast for use with the invention.

FIG. 9 shows functionally a detail of such a power supply unit 106 according to a preferred embodiment of the invention. A source voltage having a frequency 30 kHz (which may be modulated at 50 Hz) with RMS voltage of 230V is assumed, although it may be adapted to other RMS voltages by using a suitable transformer.

An Input Inductor Ballast 120 serves the function of a ballast, ie. stabilizing current, and is physically small on account of the high frequency of the current, typically equal to 30 kHz. A step-up transformer (not shown) can optionally be inserted before the Input Inductor Ballast 120 particularly in cases where the RMS value of the input voltage is lower than 230V. Such a stepup transformer also has the effect of reducing the time period during which the voltage available to the lamp drops below 100V. By such means, there may be avoided a voltage gap which if not prevented would cause the arc to extinguish. Elimination of the voltage gap may also be achieved by a valley-fill system as described below which may be used on its own or in combination with the step-up transformer. Clearly the need for a step-up transformer is also related to whether the step-up transformer 17 of FIG. 1 is included in the central power supply.

An Input Rectifier 121 is connected to an output of the Input Inductor Ballast 120 for rectifying the current so that high frequency is not applied to the lamp. An Inverter 122 coupled to an output of the Input Rectifier 121 switches the current at 100 times a second in order to reconstruct 50 Hz alternating current which is more suitable than direct current for powering most HID lamps. Thus, the Input Rectifier 121 in combination with the Inverter 122 act as a frequency conversion means for reducing the high frequency current to mains frequency. In this example the switching is performed in synchrony with the 50 Hz of the input current in order to maintain a high power factor. If the HID lamp being powered can be used with direct current, then the inverter 122 may be omitted altogether, the present invention therefore being well suited to such lamps. In this example the Inverter 122 is also responsible for generating a 5V source for use within the power supply unit 106.

A Synchronization and Auxiliary unit 123 is fed a current signal from the Input Inductor Ballast 120 for generating a drive signal for driving the Inverter 122 in synchrony with the 50 Hz of the input current. In this example it also generates a 12V source for use within the power supply unit 106. A Resistor Shunt 124 constituted by a small resistor connected in series with an output from the Input Rectifier for monitoring current flow in the system.

A Power Supply for Valley Fill 125 draws residual energy from the Input Inductor Ballast 120 at times in the 50 Hz cycle of the input current where the amplitude is not close to zero and stores the residual energy in a capacitor. A Current Limit for Valley Fill system 126 receives a synchronizing signal from the Synchronization and Auxiliary unit 123 and is connected across the capacitor in the Power Supply for Valley Fill 125 for linearly discharging the capacitor back to the system whenever the amplitude is close to zero. In this example the same system also disables the synchronization for the first few seconds of system operation m order to facilitate ignition by allowing the switching to occur other than at moments of zero voltage. An Igniter 127 is responsively coupled to the inverter 122 for generating high voltage pulses for lamp ignition.

FIGS. 10 to 17 are block diagrams showing functionally particular implementations of each of the functional components described above with reference to FIG. 9.

Figure 10:
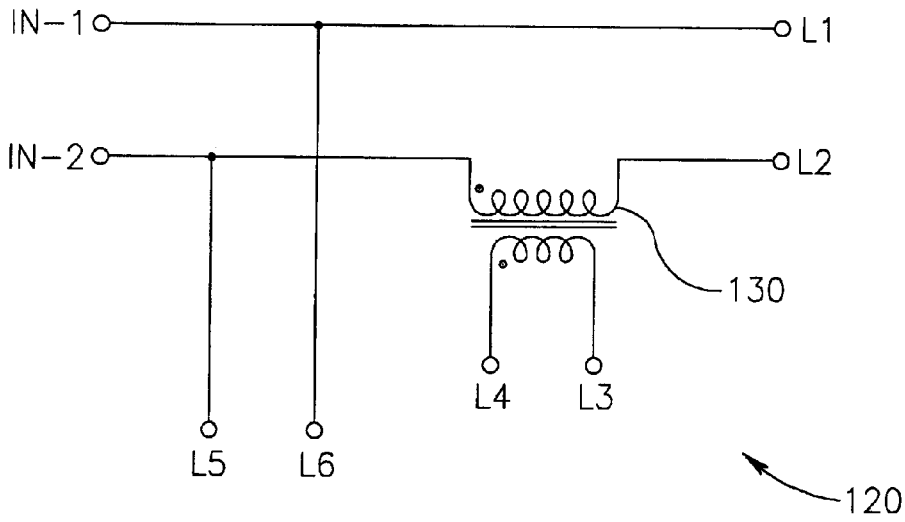
FIG. 10 is an electrical scheme showing a possible implementation of the Input Inductor Ballast block shown in FIG. 9.

Thus, as shown in FIG. 10, the Input Inductor Ballast 120 is realized by a 0.95 mH inductance 130 which serves the function of stabilizing the 20 kHz to 30 kHz current. This same inductance 130 has very low impedance at 50 Hz or 60 Hz and so does not interfere with the power factor. Energy is tapped from the inductance 130 and supplied through terminals L3 and L4 to the Valley-Fill system 126 described in greater detail below with particular reference to FIGS. 15 and 16 of the drawings. Terminals L5 and L6 of the inductance 130 allow energy to be drawn and also provide information on the phase of the 50 Hz cycle for powering the integrated circuits in the system and for synchronizing the Inveter 122.

Figure 11:
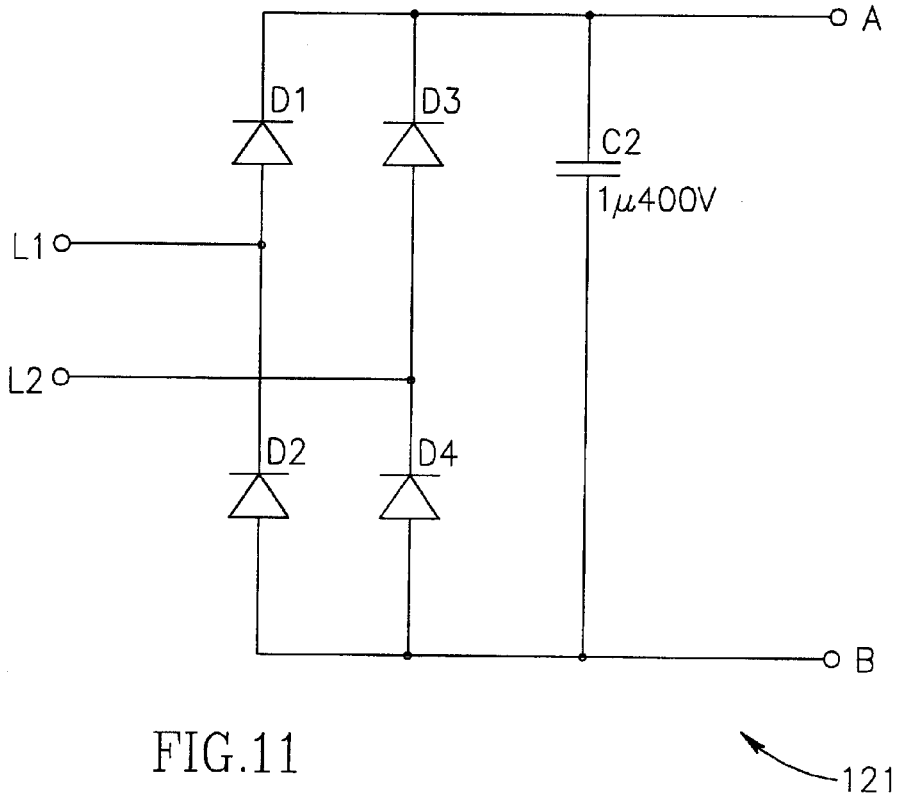
FIG. 11 is an electrical scheme showing a possible implementation of the Input Rectifier block shown in FIG. 9.

FIG. 11 shows that the Input Rectifier 121 is realized by a full bridge rectifier comprising rectifier diodes D1–D4 and a capacitor C2 which removes ripple voltages.

Figure 12A:
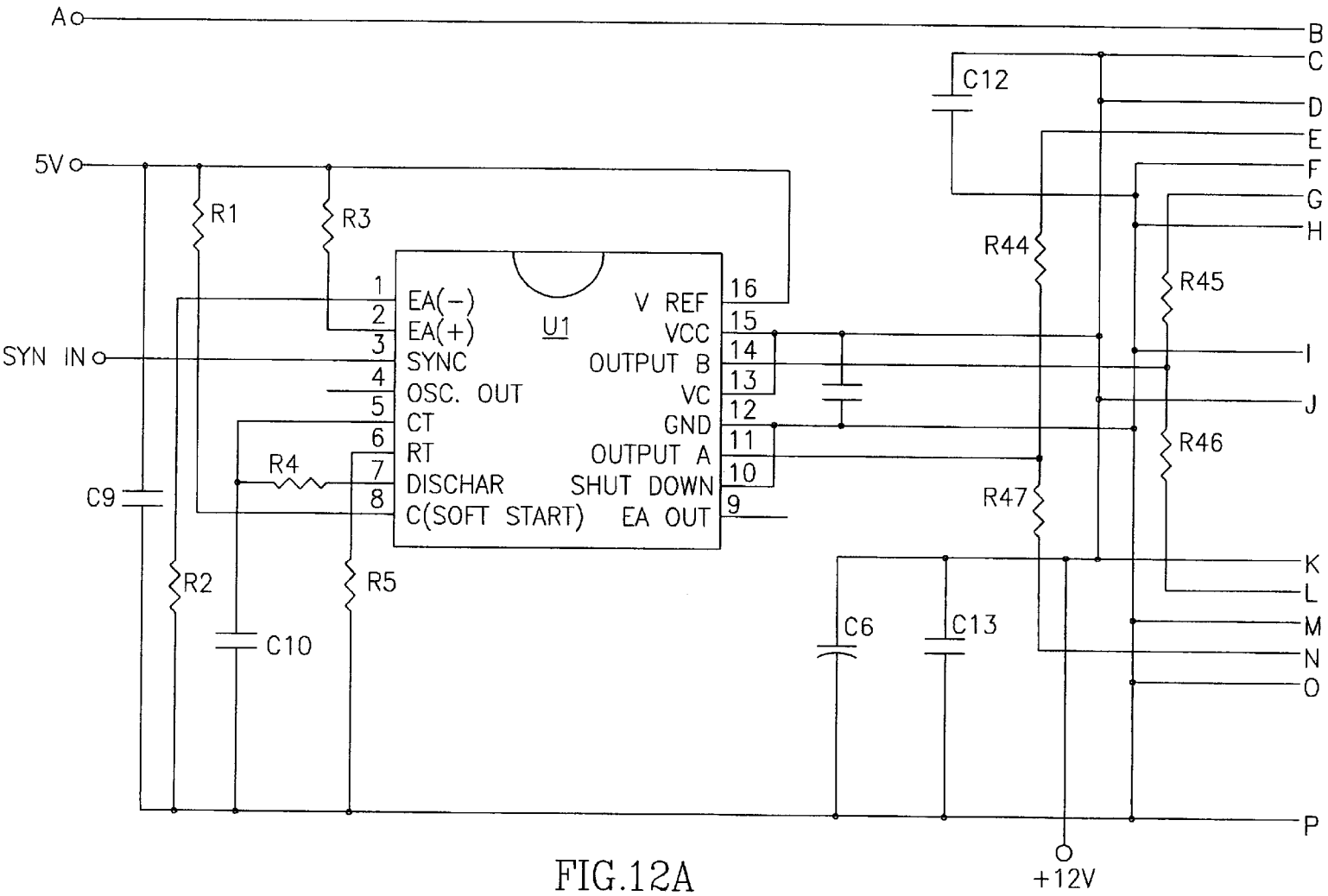
FIGS. 12A and 12B show schematically an electrical circuit of a possible implementation of the Inverter block shown in FIG. 9.
Figure 12B:
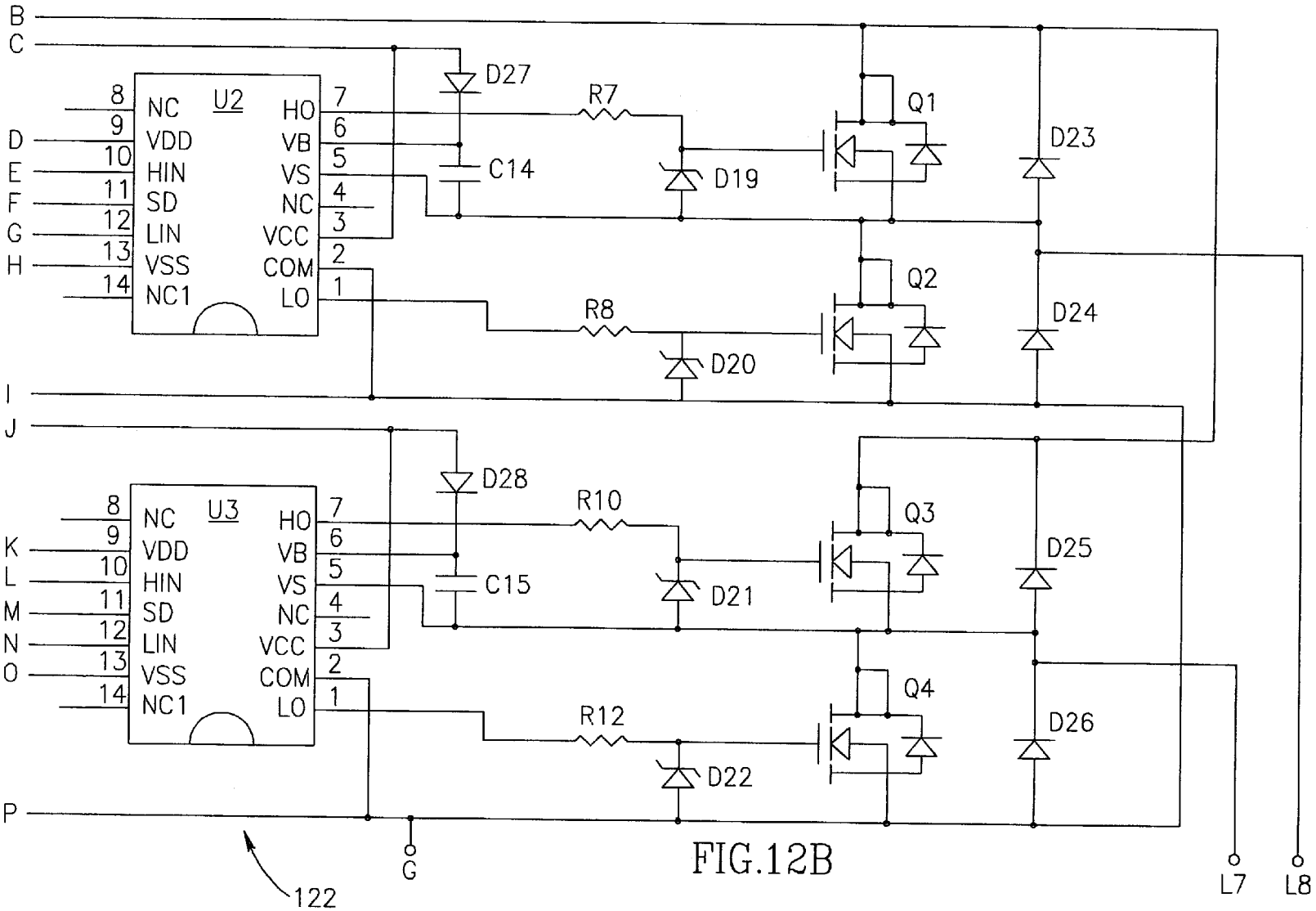

FIG. 12 shows the Inverter 122 based on a fill bridge of FETs Q1–Q4. A pair of standard driver chips U2 and U3 is used to drive the FETs. The driver chip U1 generates the timing of the switching signal which is set by R5 and C10 to 30 Hz, as used during ignition. After ignition, chip U1 switches the bridge 100 times per second in phase with the zero-crossing of the input current such synchronization occuring via a signal SYS_IN. The same component U1 also generates a 5V reference voltage which is used throughout the system. Other components serve standard functions of conditioning and controlling the voltages in the system or protecting components, and are therefore not described in further detail. Many alternative inverter circuits are known in the literature.

Figure 13A:
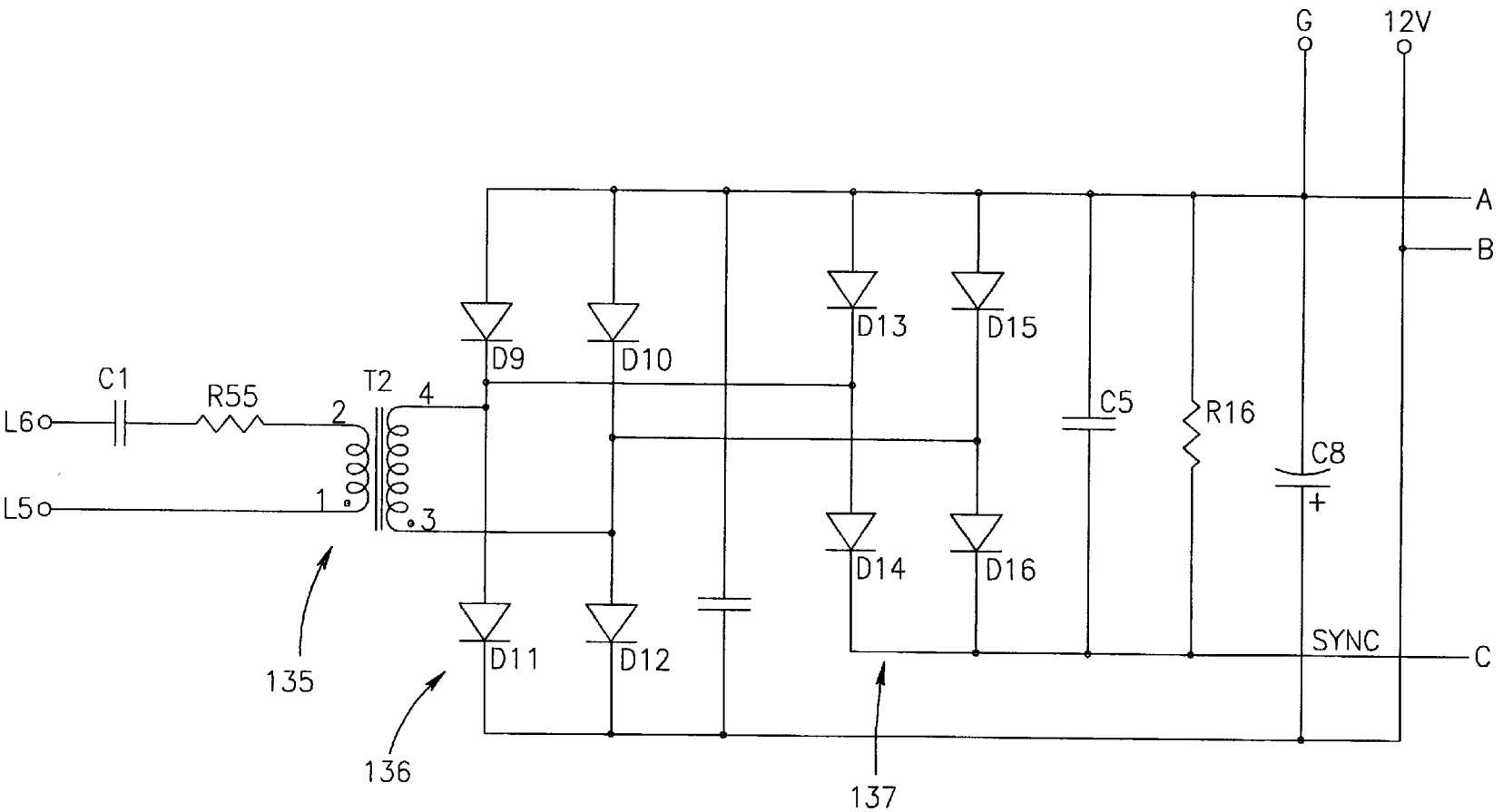
FIGS. 13A and 13B show schematically an electrical circuit of a possible implementation of the Synchro+ Auxiliary block shown in FIG. 9.
Figure 13B:
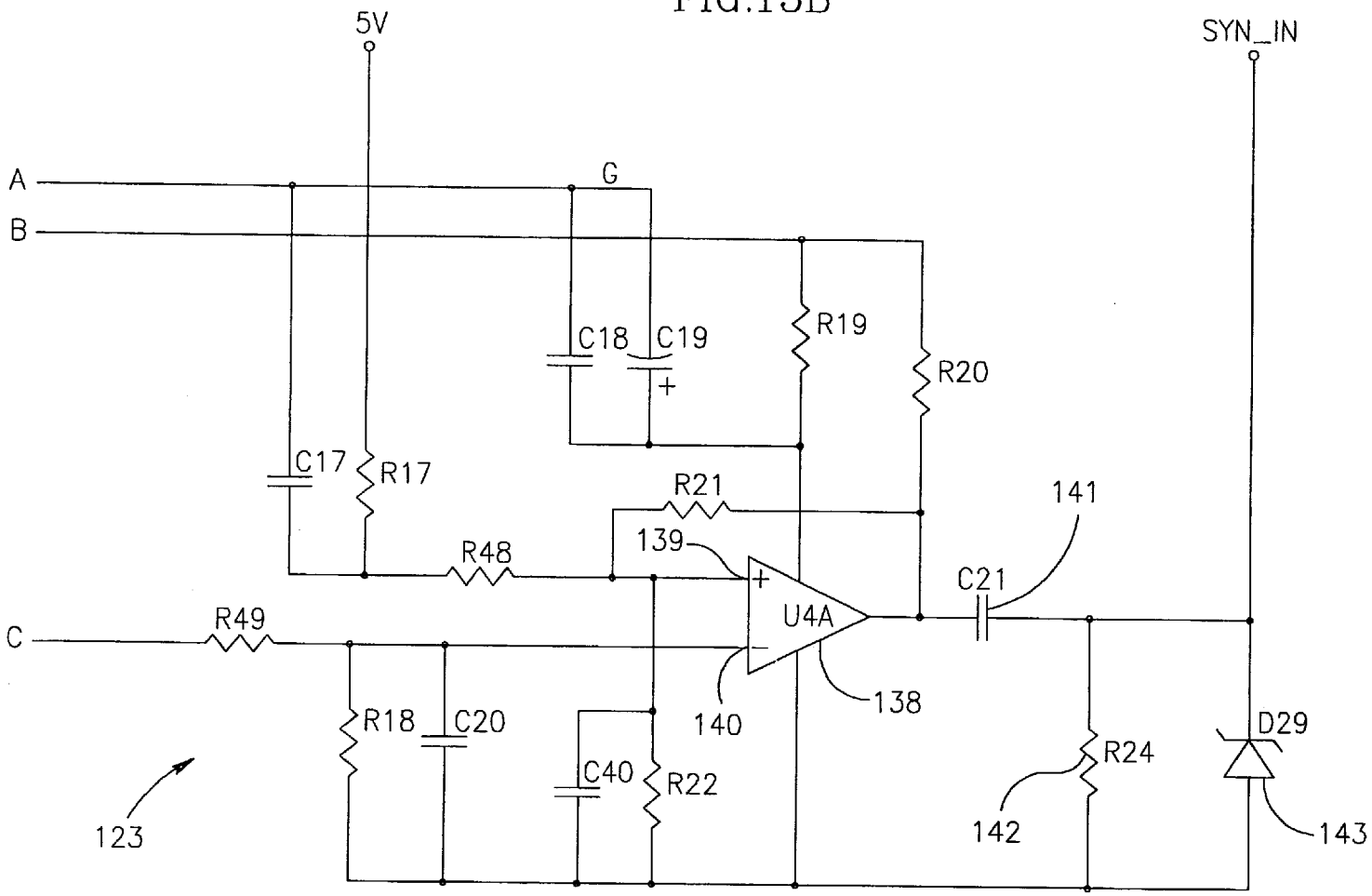

FIG. 13 shows the Synchronization and Auxiliary unit 123 which generates the signal SYS_IN for timing the Inverter 122 and also generates a source of 12V for powering the integrated circuit components in the system. Power is drawn through a transformer 135 which reduces the voltage to 12V. A f diode bridge shown generally as 136 and comprising rectifier diodes D9–D12 generates a 12V DC output. A second diode bridge shown generally as 137 and comprising rectifier diodes D13–D16 generates rectified 50 Hz current for the synchronization. A comparator 138 compares a small positive reference applied to an non-inverting input 139 thereof with the rectified 50 Hz applied to its inverting input 140 and generates a 2 ms pulse on SYS_IN having a frequency of 100 Hz whenever the amplitude of the 50 Hz signal drops below the reference voltage, i.e. is close to 0V. A differential circuit comprising a capacitor 141, a resistor 142 and a zener diode D29 convert the signal at the output of the comparator 138 to a 4.5V 50 $\mu$s pulse which is applied to SYS_IN. Other components serve standard functions of conditioning and controlling the voltages in the system or protecting components, and so are not described in farther detail.

Figure 14:
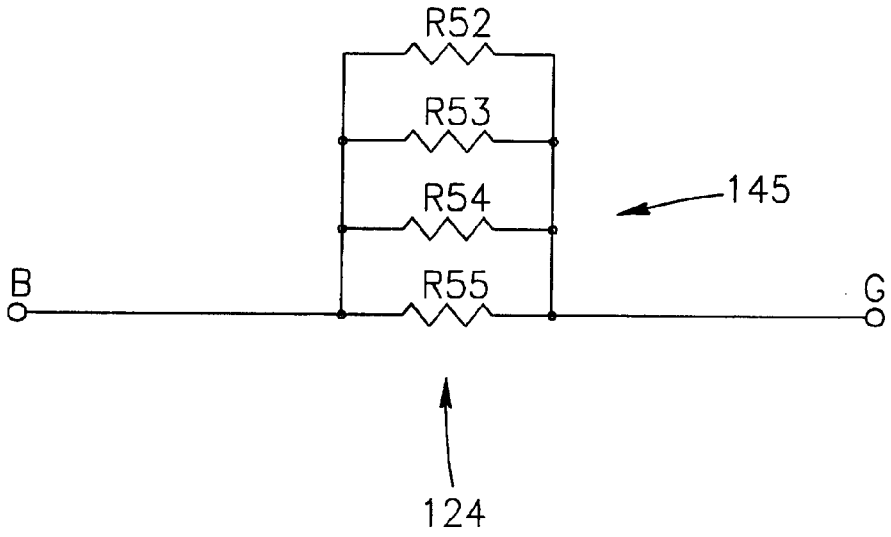
FIG. 14 is an electrical scheme showing a possible implementation of the Resistor Shunt block shown in FIG. 9.

FIG. 14 shows the resistor shunt 124 which is realized by four resistors 145 connected in parallel so as to sink the substantial power and which give rise to a voltage difference between terminals B and G proportional to the current in the system.

Figure 15:
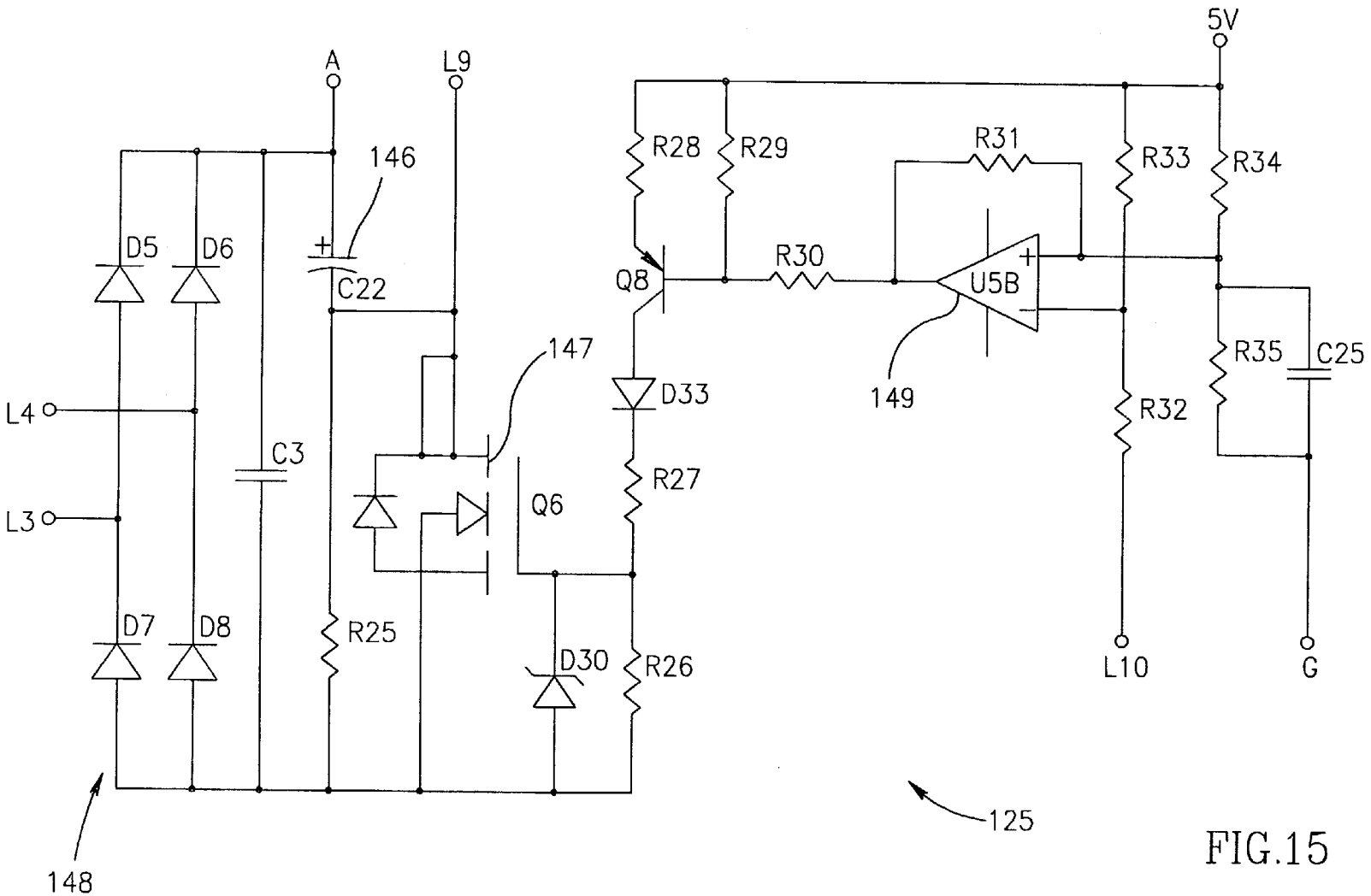
FIG. 15 is an electrical scheme showing a possible implementation of the Power for Valley Fill block shown in FIG. 9.

FIG. 15 shows an energy storage capacitor 146 which stores energy for the valley-fill unit 125 and connected to an output of which is an FET 147 which, when cut-in, allows for the capacitor 146 to be charged with the energy drawn from L3 and L4 via a diode bridge 148. A comparator 149 and associated components serve to ensure that the capacitor 146 is charged to a voltage equal to 15V more than the voltage on the lamp, i.e. the voltage across terminals A and G. Other components serve standard functions of conditioning and controlling the voltages in the system or protecting components, and so are not described in further detail.

Figure 16:
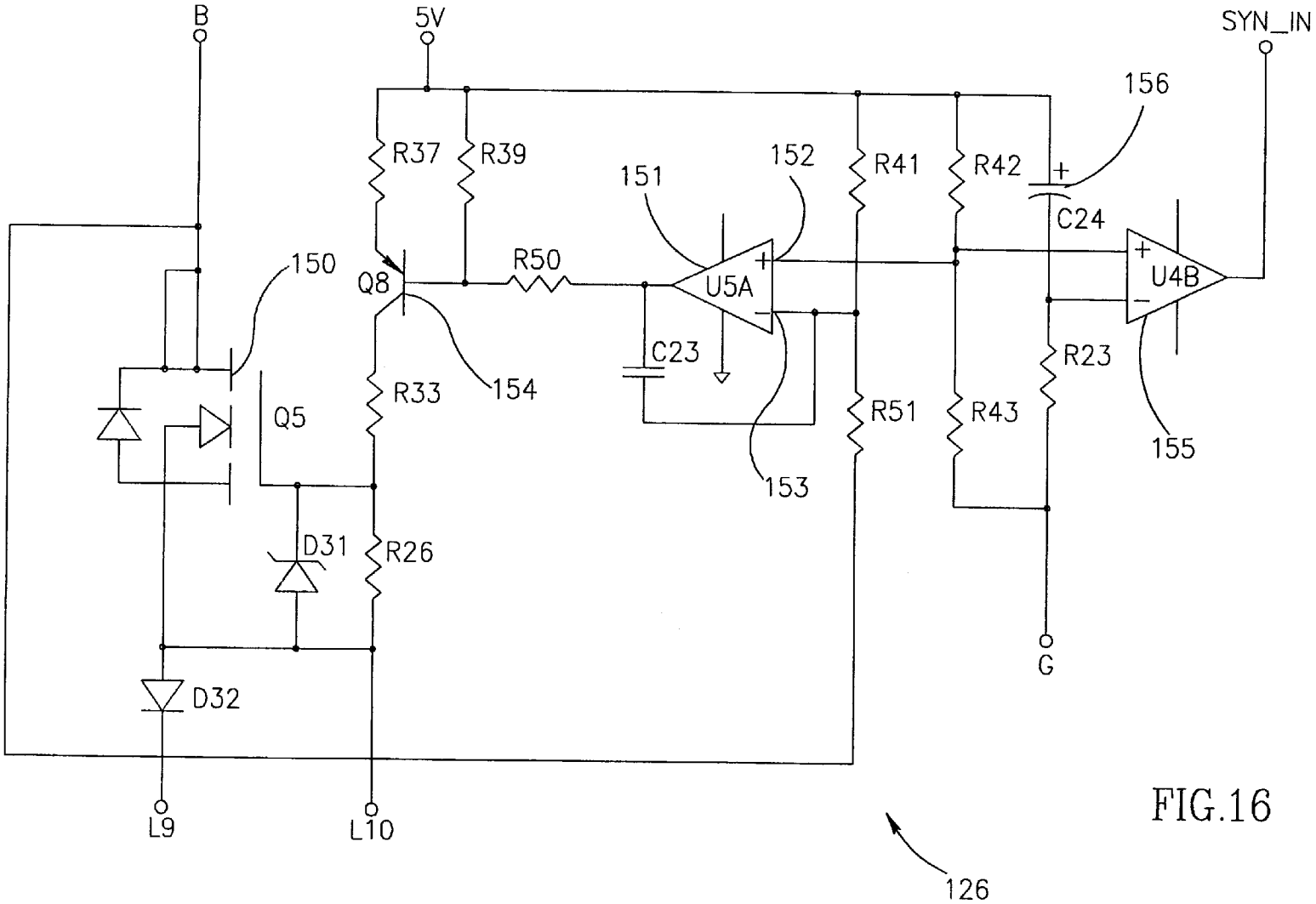
FIG. 16 is an electrical scheme showing a possible implementation of the Current Limit Valley Fill block shown in FIG. 9.

FIG. 16 shows in detail the Current Limit Valley Fill unit 126. A MOSFET 150 serves linearly to control the release of power from the capacitor 146 (shown in FIG. 15) to the terminals A and B. An OP AMP voltage comparator 151 and associated components measure the difference between the current m the system (proportional to the voltage difference between B and G) which is applied to the non-inverting input 152 of the comparator 151. Connected to the inverting input 153 of the comparator 151 is a reference voltage and an output of the comparator 151 is fed, via a bipolar junction transistor 154 to the gate terminal of the MOSFET 150 which is adapted to conduct when the current in the system drops below approx. 0.5 amp.

A comparator 155 serves to short-circuit SYS_IN and G for the first 15 seconds of the circuit's operation in order to avoid synchronization of the inverter 122 with the utility power during this time. This ensures that the inverter 122 does not perform its switching operations at times when the voltage of the input current source has zero amplitude thus giving the voltage jump necessary for the igniter 127 as described in greater detail below with reference to FIG. 10. A capacitor 156 is coupled between the 5V supply rail and the non-inverting input of the comparator 155 and filly charges after 15 seconds whereupon the output of the comparator 155 goes low thereby removing the short-circuit. Other components serve standard functions of conditioning and controlling the voltages in the system or protecting components. An alternative approach is to suppress synchronization not for a fixed time but until lamp ignition is detected. This detection may be effected by measuring the voltage across the lamp which is typically as low as 10V shortly after ignition.

Figure 17:
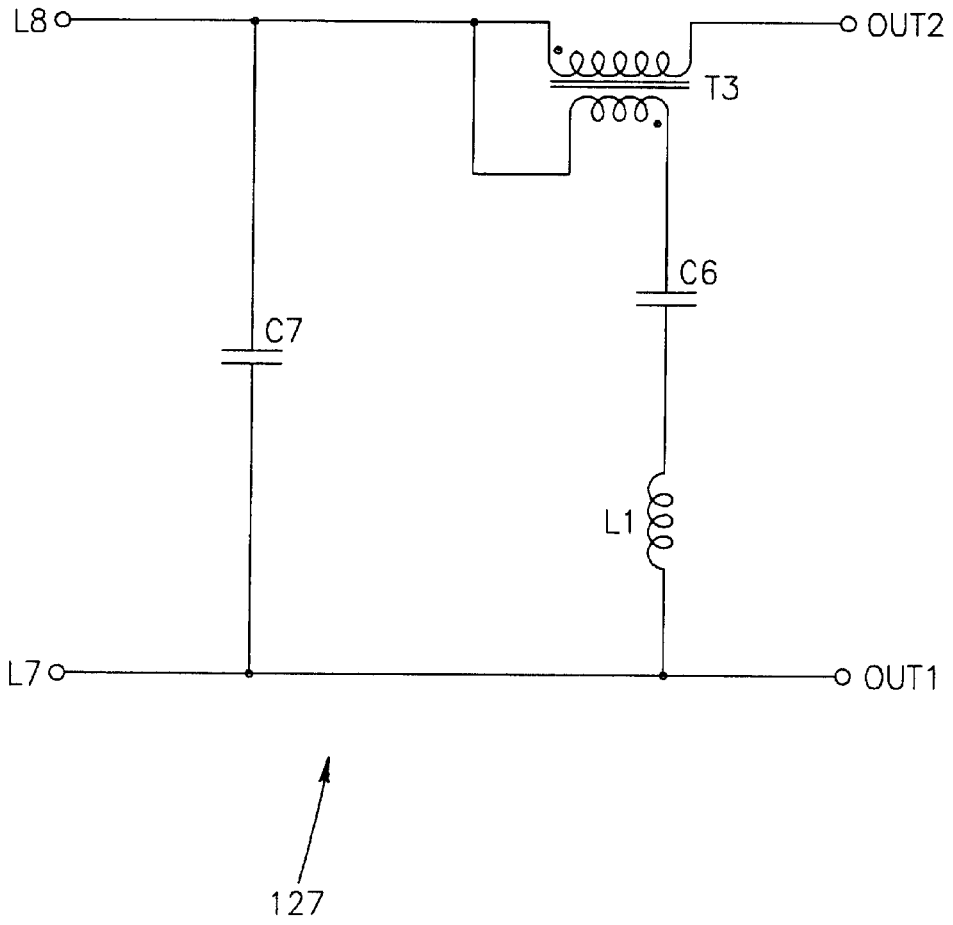
FIG. 17 is an electrical scheme showing a possible implementation of the Igniter block shown in FIG. 9.

FIG. 17 shows a detail of the igniter 127 which, when there is a jump in the voltage provided to it from the inverter 122 between its output terminals L7 and L8, generates a 1.7 $\mu$s pulse of approximately 4 kV to ignite the lamp.

Figure 18A:
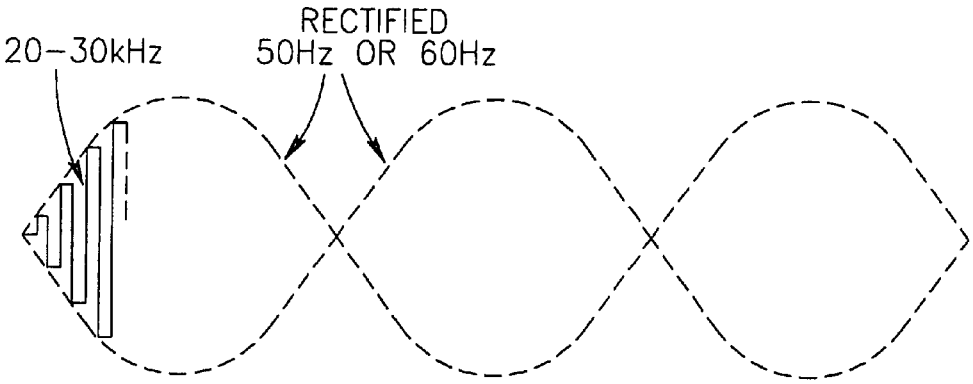
FIGS. 18*a* to 18*c* show graphically the voltages and currents in the HID ballast depicted in earlier figures.
Figure 18B:
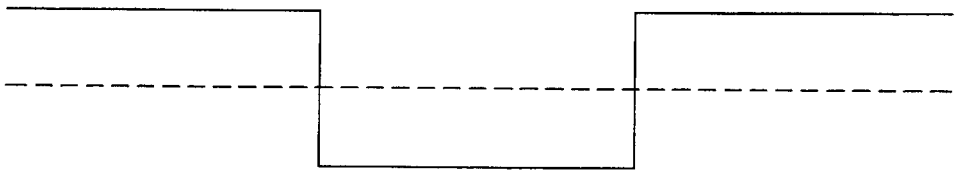
Figure 18C:
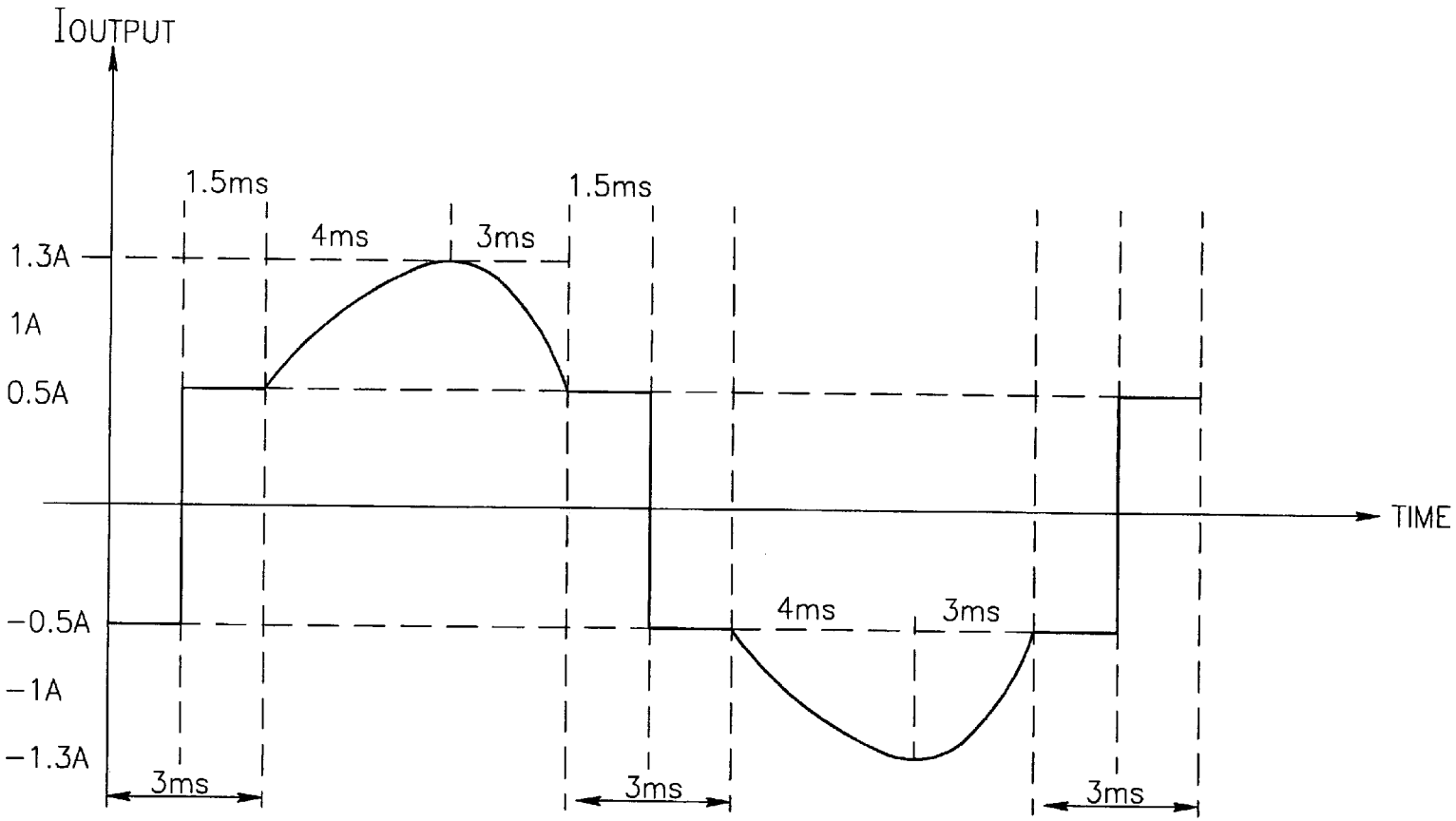

Shown schematically in FIGS. 18*a* to 18*c*, respectively, are the voltage at the input terminals, the voltage at the output terminals, and the current in the power supply unit 1 during steady operation.

The input voltage shown in FIG. 18*a* may be created by the central power supply according to the invention as shown in FIG. 1 and FIG. 4 (with the detail of the 30 KHz wave varying accordingly). Note that when used with the central power supply in FIG. 6 there is no modulation and the need for a valley fill system is eliminated. The output voltage shown in FIG. 18*b* is square owing to the behavior of the HID lamp which acts like a zener diode. Its frequency is 50 Hz and the zero cross-over is synchronized with the zero cross-over of the input current As shown in FIG. 18*c*, the current is quasi-sinusoidal near the voltage peaks although it is influenced by the fixed voltage across the HID lamp and also by the drawing of current for the valley-fill unit Near the zero cross-over, the current is maintained at a constant 0.5 amps using charge stored by the valley-fill system thus preserving the arc in the lamp. The current is sufficiently close to a sine wave as to give the system an acceptably high power factor.

FIG. 19 shows in cross-section a shielded track designated generally 200 comprising an outer metallic shielding 201 enclosing a pair of conductors 202. As seen in the figure, the two conductors 202 are almost totally surrounded by the metallic shielding 201 and are placed in spaced apart relationship separated by a minimum distance allowed by safety standards. In order to reduce radiation from the track the two conductors 202 have flattened near rectangular cross-sections which are placed in substantially parallel relationship.

It will be appreciated that such a track design has applications for systems other than the invention such as low-voltage lighting tracks with electronic transformers.

What is claimed is:

1. An illumination system comprising:

a power supply circuit having an input for connecting to a voltage source of low fundamental frequency for providing an output voltage which is alternating with fundamental frequency between approximately 15 KHz and 50 KHz with harmonics substantially weaker than those of a square wave of equal fundamental frequency, a housing for accommodating said power supply circuit, and a pair of terminals mounted in the housing and being connected to an output of the power supply circuit for attaching at least two lighting fixtures thereto via a pair of conductors selected from the following types:

a fixture containing a high-frequency ballast means and high-frequency ignition means and a fluorescent or compact fluorescent lamp, a fixture containing a high-frequency ballast means and high-frequency ignition means and a high intensity discharge lamp, a fixture containing a high-frequency step-down transformer means and a low voltage lamp a fixture containing a line-voltage incandescent lamp, and a fixture containing a pair of auxiliary conductors with an RMS voltage between them of approximately 12V to 24V coupled via a high-frequency transformer to the pair of conductors for connecting thereto at least two low voltage lamps.

2. An illumination system comprising: a power supply circuit having an input for connecting to a voltage source of low fundamental frequency for providing an output voltage which is alternating with fundamental frequency between approximately 15 KHz and 50 KHz to a first pair of conductors serving as a main power bus and a second output voltage with magnitude of order 3V to a second pair of conductors, and a plurality of high frequency ballast circuits coupled to the main power bus for powering compact fluorescent lamps such lamps also being coupled to the second pair of conductors for providing electrode heating.

3. An illumination system comprising:

a power supply circuit having an input for connecting to a voltage source of low fundamental frequency for providing an output voltage which is alternating with fundamental frequency between approximately 15 KHz and 50 KHz and with RMS voltage between approximately 12V and 24V, a pair of conductors coupled to an output of the power supply circuit, and a second power supply circuit for use with a high intensity gas discharge lamp coupled to the pair of conductors, the second power supply circuit comprising:

a pair of input terminals for connecting to said conductors, a ballast coupled to the input terminals for stabilizing a magnitude of said current, and a pair of output terminals coupled to the ballast for connecting an HID lamp thereto.

4. An illumination system comprising:

a power supply circuit having an input for connecting to a voltage source of low fundamental frequency for providing an output voltage which is alternating with fundamental frequency between approximately 15 KHz and 50 KHz, a pair of conductors coupled to an output of the power supply circuit, and a second power supply circuit for use with a high intensity gas discharge lamp coupled to the pair of conductors, the second power supply unit comprising:

a pair of input terminals for connecting to said conductors, a ballast coupled to the input terminals for stabilizing a magnitude of said current, a pair of output terminals coupled to the ballast for connecting an HID lamp thereto, and a frequency conversion means for providing a lamp current of fundamental frequency below approximately 10 kHz to the output terminals.

5. The illumination System according to claim 4, wherein the lamp current has the same fundamental frequency as and is synchronized with the AC source.

6. The illumination System according to claim 5, wherein the synchronization is disabled for a short time following connection to the AC source.

7. The illumination System according to claim 4, wherein the frequency conversion means reduces the fundamental frequency to less than 1 kHz.

8. The illumination System according to claim 4, wherein said frequency conversion means includes a rectifier.

9. The illumination System according to claim 8, wherein rectifier is coupled to output terminals for connection to a DC HID lamp.

10. An illumination system comprising:

a power supply circuit having an input for connecting to a voltage source of low fundamental frequency for providing an output voltage which is alternating with fundamental frequency between approximately 15 KHz and 50 KHz, a pair of conductors coupled to an output of the power supply circuit, and a second power supply circuit for use with a high intensity gas discharge lamp coupled to the pair of conductors, the second power supply unit comprising:

a pair of input terminals for connecting to said conductors, a ballast coupled to the input terminals for stabilizing a magnitude of said current, a pair of output terminals coupled to the ballast for connecting an HID lamp thereto, and a rectifier for providing a lamp current of fundamental frequency below approximately 10 KHz to the output terminals, further including an auxiliary frequency converter coupled to the rectifier for increasing a fundamental frequency to a frequency higher than zero and less than approximately 10 kHz.

11. The illumination System according to claim 9, wherein the auxiliary frequency converter is coupled to an inductance for providing an ignition voltage.

12. The illumination System according to claim 4, wherein the power supply circuit is adapted for coupling to multiple lamps.

13. The illumination system according to claim 1, wherein the RMS value of the output voltage is substantially equal to the RMS voltage of the voltage source.

14. The illumination system according to claim 1, wherein the RMS value of the output voltage is less than approximately 30V.

15. The illumination system according to claim 1, wherein the RMS value of the output voltage approximately equals 12V or 24V.

16. The illumination system according to claim 15 further including a gas discharge lamp coupled to the pair of conductors.

17. The illumination system according to claim 1, wherein the RMS value of the output voltage is approximately in the range 110V to 120V.

18. The illumination system according to claim 1, wherein the RMS value of the output voltage is approximately in the range 220V to 240V.

19. The illumination system according to claim 1, wherein the RMS value of the output voltage is substantially higher than 230V.

20. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, wherein the power supply circuit is associated with a temperature-detecting means for measuring an ambient temperature and the power supply is responsively coupled to the temperature-detecting means such that the output voltage is reduced or interrupted when temperature exceeds a pre-set value.

21. The illumination system according to claim 1, wherein the power supply circuit is associated with a current-detecting means for measuring a current flow through the power supply circuit and the power supply circuit is responsively coupled to the current-detecting means such that the output voltage is reduced or interrupted when the current exceeds a pre-set value.

22. The illumination system according to claim 1, wherein the power supply circuit is associated with an impedance-detecting means for measuring an impedance across the terminals and the power supply circuit is responsively coupled to the impedance-detecting means such that the output voltage is reduced or interrupted when the impedance falls below a pre-set value.

23. The illumination system according to claim 21, wherein said current-detecting means is deactivated for a short-time following the connection of the power supply circuit to the voltage source.

24. The illumination system according to claim 22, wherein said impedance-detecting means is deactivated for a short-time following the connection of the power supply circuit to the voltage source.

25. The illumination system according to claim 1, further including a light emitting diode for indicating a fault condition.

26. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, and further including an insulating track for accommodating the pair of conductors and providing mechanical support for the lighting fixtures.

27. The illumination system according to claim 1, wherein the pair of conductors is constituted by an open conductive cable or rail.

28. The illumination system according to claim 3, wherein the pair of conductors is constituted by an open conductive cable or rail.

29. The illumination system according to claim 1, including at least one lighting fixture adapted to be recessed in a ceiling or wall.

30. The illumination system according to claim 1, including at least one lighting fixture adapted for outdoor use.

31. The illumination system according to claim 1, including at least two lighting fixtures selected from the group of:

recessed ceiling fixtures, track mounted fixtures, under-cabinet fixtures, outdoor fixtures, and wall-mounted fixtures.

32. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, wherein the first power supply is duplicated to give at least two such power supply circuits to be connected to respective pairs of conductors to run parallel to each other.

33. The illumination system according to claim 32, wherein one conductor is common to the pairs of conductors.

34. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, including at least one lighting fixture which contains:

a high-frequency ballast means, an ignition means, and a gas-discharge lamp.

35. The illumination system according to claim 34, wherein the gas discharge lamp is a high intensity discharge lamp.

36. The illumination system according to claim 34, wherein the high-frequency ballast means and ignition means are constituted by a resonant circuit.

37. The illumination system according to claim 35, wherein the high-frequency ballast means and ignition means are constituted by a circuit including:

a pair of input terminals for connecting to said conductors, a ballast coupled to the input terminals for stabilizing a magnitude of said current, and a pair of output terminals coupled to the ballast for connecting an HID lamp thereto;

said second power supply unit firer comprising a frequency conversion means for reducing the fundamental frequency to less than approximately 10 kHz.

38. The illumination system according to claim 1 further containing at least one transformer means having a primary winding coupled to the pair of conductors and having a secondary winding for producing a voltage of magnitude between approximately 12 and 24V across the pair of auxiliary conductors for connecting thereto at least two low voltage lamps.

39. The illumination system according to claim 1, including a plurality at least three fixtures from the types listed.

40. The illumination system according to claim 1, wherein:

a capacitance and inductance are connected to the pair of conductors and together with the impedance attached to the pair of conductors form a damped resonant circuit having a resonant frequency, and the fundamental frequency of the output voltage is of a similar order of magnitude as said resonant frequency.

41. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, wherein:

a capacitance and inductance are connected to the conductors and together with the impedance attached to the pair of conductors form a damped resonant circuit having a resonant frequency, and the fundamental frequency of the output voltage is of a similar order of magnitude as said resonant frequency, including frequency control means for varying the frequency of the power supply consequent to a change in said impedance such that the RMS voltage across the conductors is maintained at a pre-set value.

42. The illumination system according to claim 41, including a bank of capacitors and/or inductors each having different values of C and L, respectively, and a selection means coupled to said bank of capacitors and/or inductors for selecting a suitable capacitance and/or inductance such that a frequency of the resonant circuit is within a range of approximately 15 KHz to 50 KHz for a substantial range of different lamp-fixture loads.

43. The illumination system according to claim 41 almost totally surrounded by metallic shielding, wherein the pre-set value of the RMS voltage across the conductors is equal to a function of the RMS voltage of a sine wave of fixed reference amplitude which has been chopped in accordance with the pattern of the voltage source.

44. The illumination system according to claim 1, wherein the power supply circuit further includes a power factor correction circuit for adjusting a power factor thereof to near unity.

45. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, wherein the power supply further includes a power factor correction circuit for adjusting a power factor thereof to near unity and wherein the power factor correction circuit includes:

an inductor coupled via a switching means to the voltage source so as to store energy therefrom, a power factor regulator responsively coupled to the voltage source for operating the switching means in a high frequency duty cycle which changes sinusoidally in phase with the voltage source, and a capacitor coupled to an output of the inductor via a rectifier diode so as to receive charge therefrom when the switching means is open.

46. The illumination system according to claim 45, wherein the voltage across the conductors is maintained at a pre-set RMS value by changing the duty cycle.

47. The illumination system according to claim 46, wherein the pre-set value of the RMS voltage across the conductors is set to be equal to a function of the RMS voltage of a sine wave of fixed reference amplitude which has been chopped in accordance with the pattern of the AC source.

48. An illumination system comprising:

a power supply circuit having an input for connecting to a voltage source of low fundamental frequency for providing an output voltage which is alternating with fundamental frequency between approximately 15 KHz and 50 KHz, a pair of conductors coupled to an output of the power supply circuit, and a second power supply circuit for use with a high intensity gas discharge lamp coupled to the pair of conductors, the second power supply unit comprising:

a pair of input terminals for connecting to said conductors, a ballast coupled to the input terminals for stabilizing a magnitude of said current, a pair of output terminals coupled to the ballast for connecting an HID lamp thereto, and a frequency conversion means for providing a lamp current of fundamental frequency below approximately 10 KHz to the output terminals, further including an arc-preserving device for increasing a voltage in order to preserve an arc in a gas discharge lamp during momentary reductions in the amplitude of the voltage of the voltage source.

49. An illumination system comprising:

a first power supply circuit having an input for connecting to a voltage source of low frequency for providing an output voltage with altered frequency, and a pair of conductors coupled to an output of the first power supply circuit and serving as a main power bus, and a first lamp coupled to the main power bus via a second power supply circuit, and at least one further lamp with electrical power requirements of a different voltage-current characteristic to the first lamp coupled to said main power bus, and further including an arc-preserving device associated with the power supply circuit and including:

a capacitor, means for charging said capacitor at times when a voltage of the arc-preserving device has amplitude substantially greater than zero, and a switching means for discharging said capacitor at times when a voltage amplitude of the arc-preserving device is close to zero.

50. An illumination system comprising: a power supply circuit having an input for connecting to a voltage source of low fundamental frequency for providing an output voltage which is alternating with fundamental frequency between approximately 15 KHz and 50 KHz with harmonics substantially weaker than those of a square wave of equal fundamental frequency, a housing for accommodating said power supply circuit, a pair of terminals mounted in the housing and being connected to an output of the power supply circuit for attaching at least one lighting fixture thereto via a pair of conductors, and an arc-preserving device associated with the power supply circuit and including: a capacitor, and means for charging said capacitor at times when a voltage of the arc-preserving device has amplitude substantially greater than zero, and a switching means for discharging said capacitor at times when a voltage amplitude of the arc-preserving device is close to zero.

51. The illumination System according to claim 48 wherein the arc-preserving device is associated with the power supply circuit.

52. The illumination System according to claim 48, wherein the arc-preserving device contains:

a capacitor, and means for charging said capacitor at times when a voltage of the source of current has amplitude substantially greater than zero, and a switching means for discharging said capacitor at times when a voltage amplitude of the source of current is close to zero.

53. The illumination System according to claim 52, wherein the switching means is responsive to a magnitude of a current through the output terminals.

54. The illumination System according to claim 48 wherein the arc-preserving device deliver energy via a conductor running in parallel to the pair of conductors.

55. The illumination System according to claim 48, wherein the arc-preserving device draws energy from a power factor correction circuit such that the power factor correction circuit has a lower power rating than the power supply circuit.

56. The illumination system according to claim 1, wherein a length of the conductors of the pair exceeds 3 m.

57. The illumination system according to claims 1, wherein a length of the conductors of the pair exceeds 10 m.

58. The illumination system according to claim 1, wherein the power supply circuit is adapted to carry more than 300 watts of power.

59. The illumination system according to claim 1, wherein the power supply circuit is adapted to carry more than 1,000 watts of power.

60. The illumination system according to claim 1, wherein the pair of conductors is largely surrounded by metallic shielding.

61. The illumination system according to claim 1, wherein the pair of conductors are implemented with an approximately rectangular cross section and are aligned with their lengths parallel.

62. The illumination system according to claim 2, wherein the RMS value of the output voltage is substantially equal to the RMS voltage of the voltage source.

63. The illumination system according to claim 2, wherein the RMS value of the output voltage is less than approximately 30V.

64. The illumination system according to claim 2, wherein the RMS value of the output voltage approximately equals 12V or 24V.

65. The illumination system according to claim 64 further including a gas discharge lamp coupled to the pair of conductors.

66. The illumination system according to claim 2, wherein the RMS value of the output voltage is approximately in the range 110V to 120V.

67. The illumination system according to claim 2, wherein the RMS value of the output voltage is approximately in the range 220V to 240V.

68. The illumination system according to claim 2, wherein the RMS value of the output voltage is substantially higher than 230V.

69. The illumination system according to claim 2, wherein the power supply circuit is associated with a current-detecting means for measuring a current flow through the power supply circuit and the power supply circuit is responsively coupled to the current-detecting means such that the output voltage is reduced or interrupted when the current exceeds a pre-set value.

70. The illumination system according to claim 2, wherein the power supply circuit is associated with an impedance-detecting means for measuring an impedance across the terminals and the power supply circuit is responsively coupled to the impedance-detecting means such that the output voltage is reduced or interrupted when the impedance falls below a pre-set value.

71. The illumination system according to claim 69, wherein said current-detecting means is deactivated for a short-time following the connection of the power supply circuit to the voltage source.

72. The illumination system according to claim 70, wherein said impedance-detecting means is deactivated for a short-time following the connection of the power supply circuit to the voltage source.

73. The illumination system according to claim 2, further including a light emitting diode for indicating a fault condition.

74. The illumination system according to claim 2, wherein one of the pairs of conductors is constituted by an open conductive cable or rail.

75. The illumination system according to claim 2, including at least one lighting fixture adapted to be recessed in a ceiling or wall.

76. The illumination system according to claim 2, including at least one lighting fixture adapted for outdoor use.

77. The illumination system according to claims 2, including at least two lighting fixtures selected from the group of:

recessed ceiling fixtures, track mounted fixtures, under-cabinet fixtures, outdoor fixtures, and wall-mounted fixtures.

78. The illumination system according to claim 2, wherein:

a capacitance and inductance are connected to the conductors of the first pair and together with the impedance attached to the pair of conductors form a damped resonant circuit having a resonant frequency, and the fundamental frequency of the output voltage is of a similar order of magnitude as said resonant frequency.

79. The illumination system according to claim 2, wherein the power supply circuit further includes a power factor correction circuit for adjusting a power factor thereof to near unity.

80. The illumination system according to claim 2, wherein a length of the conductors of one of the pairs exceeds 3 m.

81. The illumination system according to claim 2, wherein a length of the conductors of one of the pairs exceeds 10 m.

82. The illumination system according to claim 2, wherein the power supply circuit is adapted to carry more than 300 watts of power.

83. The illumination system according to claim 2, wherein the power supply circuit is adapted to carry more than 1,000 watts of power.

84. The illumination system according to claim 2, wherein one of the pairs of conductors is largely surrounded by metallic shielding.

85. The illumination system according to claim 2, wherein the conductors of one of the pairs are parallel such that the distance between them is the minimum distance dictated by safety standards.

86. The illumination system according to claim 2, wherein the conductors of one of the pairs are implemented with an approximately rectangular cross section and are aligned with their lengths parallel.

87. The illumination system according to claim 3, wherein the RMS value of the output voltage is substantially equal to the RMS voltage of the voltage source.

88. The illumination system according to claim 3, wherein the RMS value of the output voltage is less than approximately 30V.

89. The illumination system according to claim 3, wherein the RMS value of the output voltage approximately equals 12V or 24V.

90. The illumination system according to claim 89 further including a gas discharge lamp coupled to the pair of conductors.

91. The illumination system according to claim 3, wherein the RMS value of the output voltage is approximately in the range 110V to 120V.

92. The illumination system according to claim 3, wherein the RMS value of the output voltage is approximately in the range 220V to 240V.

93. The illumination system according to claim 3, wherein the RMS value of the output voltage is substantially higher than 230V.

94. The illumination system according to claim 3, wherein the power supply circuit is associated with a current-detecting means for measuring a current flow through the power supply circuit and the power supply circuit is responsively coupled to the current-detecting means such that the output voltage is reduced or interrupted when the current exceeds a pre-set value.

95. The illumination system according to claim 3, wherein the power supply circuit is associated with an impedance-detecting means for measuring an impedance across the terminals and the power supply circuit is responsively coupled to the impedance-detecting means such that the output voltage is reduced or interrupted when the impedance falls below a pre-set value.

96. The illumination system according to claim 94, wherein said current-detecting means is deactivated for a short-time following the connection of the power supply circuit to the voltage source.

97. The illumination system according to claim 95, wherein said impedance-detecting means is deactivated for a short-time following the connection of the power supply circuit to the voltage source.

98. The illumination system according to claim 3, further including a light emitting diode for indicating a fault condition.

99. The illumination system according to claim 3, including at least one lighting fixture adapted to be recessed in a ceiling or wall.

100. The illumination system according to claim 3, including at least one lighting fixture adapted for outdoor use.

101. The illumination system according to claim 3, including at least two lighting fixtures selected from the group of:

recessed ceiling fixtures, track mounted fixtures, under-cabinet fixtures, outdoor fixtures, and wall-mounted fixtures.

102. The illumination system according to claim 3, wherein:

a capacitance and inductance are connected to the pair of conductors and together with the impedance attached to the pair of conductors form a damped resonant circuit having a resonant frequency, and the fundamental frequency of the output voltage is of a similar order of magnitude as said resonant frequency.

103. The illumination system according to claim 3, wherein the power supply circuit further includes a power factor correction circuit for adjusting a power factor thereof to near unity.

104. The illumination system according to claim 3, wherein a length of the conductors exceeds 3 m.

105. The illumination system according to claim 3, wherein a length of the conductors exceeds 10 m.

106. The illumination system according to claim 3, wherein the power supply circuit is adapted to carry more than 300 watts of power.

107. The illumination system according to claim 3, wherein the power supply circuit is adapted to carry more than 1,000 watts of power.

108. The illumination system according to claim 3, wherein the pair of conductors is largely surrounded by metallic shielding.

109. The illumination system according to claim 3, wherein the conductors of the pair are parallel such that the distance between them is the minimum distance dictated by safety standards.

110. The illumination system according to claim 3, wherein the conductors of pair are implemented with an approximately rectangular cross section and are aligned with their lengths parallel.

111. The illumination system according to claim 4, wherein the RMS value of the output voltage is substantially equal to the RMS voltage of the voltage source.

112. The illumination system according to claim 4, wherein the RMS value of the output voltage is less than approximately 30V.

113. The illumination system according to claim 4, wherein the RMS value of the output voltage approximately equals 12V or 24V.

114. The illumination system according to claim 113, further including a gas discharge lamp coupled to the pair of conductors.

115. The illumination system according to claim 4, wherein the RMS value of the output voltage is approximately in the range 110V to 120V.

116. The illumination system according to claim 4, wherein the RMS value of the output voltage is approximately in the range 220V to 240V.

117. The illumination system according to claim 4, wherein the RMS value of the output voltage is substantially higher than 230V.

118. The illumination system according to claim 4, wherein the power supply circuit is associated with a current-detecting means for measuring a current flow through the power supply circuit and the power supply circuit is responsively coupled to the current-detecting means such that the output voltage is reduced or interrupted when the current exceeds a pre-set value.

119. The illumination system according to claim 4, wherein the power supply circuit is associated with an impedance-detecting means for measuring an impedance across the terminals and the power supply circuit is responsively coupled to the impedance-detecting means such that the output voltage is reduced or interrupted when the impedance falls below a pre-set value.

120. The illumination system according to claim 118, wherein said current-detecting means is deactivated for a short-time following the connection of the power supply circuit to the voltage source.

121. The illumination system according to claim 119, wherein said impedance-detecting means is deactivated for a short-time following the connection of the power supply circuit to the voltage source.

122. The illumination system according to claim 4, further including light emitting diode for indicating a fault condition.

123. The illumination system according to claim 4, including at least one lighting fixture adapted to be recessed in a ceiling or wall.

124. The illumination system according to claim 4, including at least one lighting fixture adapted for outdoor use.

125. The illumination system according to claim 4, including at least two lighting fixtures selected from the group of:

recessed ceiling fixtures, track mounted fixtures, under-cabinet fixtures, outdoor fixtures, and wall-mounted fixtures.

126. The illumination system according to claim 4, wherein:

a capacitance and inductance are connected to the pair of conductors and together with the impedance attached to the pair of conductors form a damped resonant circuit having a resonant frequency, and the fundamental frequency of the output voltage is of a similar order of magnitude as said resonant frequency.

127. The illumination system according to claim 4, wherein the power supply circuit further includes a power factor correction circuit for adjusting a power factor thereof to near unity.

128. The illumination system according to claim 4, wherein a length of the conductors exceeds 3 m.

129. The illumination system according to claim 4, wherein a length of the conductors exceeds 10 m.

130. The illumination system according to claim 4, wherein the power supply circuit is adapted to carry more than 300 watts of power.

131. The illumination system according to claim 4, wherein the power supply circuit is adapted to carry more than 1,000 watts of power.

132. The illumination system according to claim 4, wherein the pair of conductors is largely surrounded by metallic shielding.

133. The illumination system according to claim 4, wherein the conductors of the pair are parallel such that the distance between them is the minimum distance dictated by safety standards.

134. The illumination system according to claim 4, wherein the conductors of pair are implemented with an approximately rectangular cross section and are aligned with their lengths parallel.

* * * * *